US010226159B2

(12) United States Patent
Baker et al.

(10) Patent No.: US 10,226,159 B2
(45) Date of Patent: Mar. 12, 2019

(54) CLEANING HEAD ASSEMBLIES HAVING TOUCH-FREE ATTACHMENT AND ALIGNMENT TECHNOLOGY

(71) Applicant: Tennant Company, Minneapolis, MN (US)

(72) Inventors: Leo Jason Baker, Holland, MI (US); Jeremy Clinton Stoddard, Holland, MI (US); Steven James Leibrandt, Muskegon, MI (US); Justin Michael Clark, Hudsonville, MI (US); Nathan Scott Meyer, Zeeland, MI (US)

(73) Assignee: Tennant Company, Minneapolis, MN (US)

( * ) Notice: Subject to any disclaimer, the term of this patent is extended or adjusted under 35 U.S.C. 154(b) by 405 days.

(21) Appl. No.: 14/191,892

(22) Filed: Feb. 27, 2014

(65) Prior Publication Data

US 2014/0237743 A1 Aug. 28, 2014

Related U.S. Application Data

(60) Provisional application No. 61/769,891, filed on Feb. 27, 2013, provisional application No. 61/831,942, filed on Jun. 6, 2013.

(51) Int. Cl.
*A47L 11/40* (2006.01)
*A47L 11/283* (2006.01)

(52) U.S. Cl.
CPC ..... *A47L 11/4069* (2013.01); *A47L 11/283* (2013.01); *A47L 11/4038* (2013.01)

(58) Field of Classification Search
CPC ..... B23B 2270/08; B23Q 17/2216; B23Q 3/1543; A47L 11/283; A47L 11/4038;
(Continued)

(56) References Cited

U.S. PATENT DOCUMENTS 2,561,279 A * 7/1951 Holt ..... A47L 11/164 15/180
2,727,262 A * 12/1955 Gerber ..... A47L 11/16 15/324

(Continued)

FOREIGN PATENT DOCUMENTS

CN 101267759 A 9/2008
CN 101487239 A 7/2009

(Continued)

OTHER PUBLICATIONS

Tennant Company, "Parts Manual, Tennant Wet Scrubber Model 432," available online at: http://assets.tennantco.com/globalassets/technicalassets/operator%20and%20parts%20manuals/mm155.pdf, Sep. 2, 2002, p. 5-11, annotated with additional images on pp. 77-80 (80 pages).

(Continued)

*Primary Examiner* — Joseph J Hail
*Assistant Examiner* — Arman Milanian
(74) *Attorney, Agent, or Firm* — Fredrikson & Byron, P.A.

(57) ABSTRACT

Embodiments include a cleaning head assembly for a floor surface maintenance machine. The cleaning head assembly can include a hub (or cleaning head housing) and a pad driver, wherein the pad driver attaches to and aligns axially with the hub (or cleaning head housing) in a touch-free manner.

24 Claims, 23 Drawing Sheets

(58) Field of Classification Search
CPC ..... A47L 11/4069; F16D 1/076; F16D 3/185; H02K 49/102
USPC ..... 408/239 A; 15/28, 230, 179
See application file for complete search history.

(56) References Cited

U.S. PATENT DOCUMENTS 2,992,715 A * 7/1961 Blachly ..... A47J 43/046 192/108
3,055,030 A * 9/1962 Ardito ..... A47L 11/164 15/49.1
3,162,876 A * 12/1964 Erickson ..... A47L 23/06 15/28
3,289,231 A * 12/1966 Minton ..... A47L 23/06 15/28
3,289,232 A * 12/1966 Beach ..... A47L 11/1625 15/29
3,290,918 A * 12/1966 Weasler ..... F16D 1/10 29/893.2
3,445,877 A 5/1969 Stout
3,501,798 A * 3/1970 Carraro ..... A47L 1/02 15/103
3,542,178 A * 11/1970 Ripple ..... F16D 1/101 192/108
3,562,843 A * 2/1971 Belicka ..... A46B 13/008 15/180
3,600,735 A * 8/1971 Jerabek ..... A47L 11/164 15/159.1
3,917,042 A * 11/1975 Summa ..... B23Q 16/08 192/108
3,970,407 A * 7/1976 Uffman ..... B23B 31/28 408/204
4,251,896 A * 2/1981 Block ..... A47L 11/162 15/49.1
4,373,828 A * 2/1983 Sartori ..... B25G 3/16 15/145
4,391,548 A * 7/1983 Malish ..... A47L 11/164 15/49.1
5,421,053 A * 6/1995 Chodak ..... A47L 11/164 15/180
5,806,132 A * 9/1998 Kelley ..... A47L 11/164 15/230.17
5,895,189 A * 4/1999 Ruckert ..... F16B 5/0233 403/DIG. 1
5,950,270 A * 9/1999 Tono ..... A47L 11/164 15/98
6,121,142 A * 9/2000 Crevasse ..... B24B 37/04 438/691
7,736,216 B2 * 6/2010 King ..... B24B 23/04 451/357
7,987,546 B2 * 8/2011 Poch ..... A47L 11/24 15/179
8,029,340 B2 * 10/2011 Henning ..... B24B 23/02 451/359
8,978,190 B2 * 3/2015 Leifheit ..... A47L 11/162 15/230
2003/0115697 A1 * 6/2003 Deiterman ..... A47L 11/164 15/49.1
2004/0255420 A1 * 12/2004 Shary ..... A47L 11/164 15/230.17
2008/0216259 A1 * 9/2008 Walz ..... A47L 11/4052 15/49.1
2010/0133761 A1 * 6/2010 Waggle ..... B23B 31/11 279/143
2014/0007368 A1 * 1/2014 Larson ..... A47L 11/283 15/256.5

FOREIGN PATENT DOCUMENTS

CN 102481601 A 5/2012
CN 202313140 U 7/2012
CN 202553818 U 11/2012
EP 0251987 B1 * 5/1987 ..... A47L 11/14
EP 0231604 A1 8/1987
EP 0238720 A1 * 9/1987 ..... A47L 11/64
EP 2189097 A2 * 5/2010 ..... A47L 11/08
FR 1454295 A 7/1966
JP H04077859 U 7/1992
JP H06318480 A 11/1994
JP 2006314677 A 11/2006

OTHER PUBLICATIONS

International Searching Authority, The International Search Report and the Written Opinion of the International Searching Authority, or the Declaration for PCT/US2014/018483, dated Jun. 17, 2014, 9 pages.
English Machine translation of Japanese Publication No. H06-318480, published Nov. 15, 1994, 6 pages.
English Machine translation of Japanese Publication No. JP2006-314677A, published Nov. 24, 2006, 18 pages.
English Machine translation of Japanese Publication No. H04-077859, published Jul. 7, 1992, 2 pages.

* cited by examiner

CLEANING HEAD ASSEMBLIES HAVING TOUCH-FREE ATTACHMENT AND ALIGNMENT TECHNOLOGY

FIELD OF THE INVENTION

The present invention generally relates to surface maintenance machines. More particularly the present invention relates to a cleaning head assembly for use with such machines, the cleaning head assembly having touch-free attachment and alignment technology.

BACKGROUND OF THE INVENTION

Surface maintenance machines include vehicles and devices that can be self-powered, towed, or pushed, and/or manually powered. Surface maintenance machines commonly include a cleaning head that includes one or more cleaning tools operated by one or more motors. Each cleaning tool is configured to perform a desired treating operation on the floor surface. For example, in cases where the surface maintenance machine is a floor scrubbing machine, the cleaning head includes one or more brushes that scrub the floor. Likewise, in cases where the surface maintenance machine is a floor sweeping machine, the cleaning head includes one or more brushes that contact the floor and throw loose debris into a hopper. The cleaning head is typically located on an underside of a surface maintenance machine.

A typical cleaning head generally includes a motor, deck, hub and pad driver. The hub attaches to the motor and deck and the pad driver then attaches to the hub. In order to attach the pad driver to the hub, a user holds the pad driver in his/her hands and positions the pad driver under the cleaning head assembly. The user then uses his/her hands to manipulate the pad driver until the pad driver aligns with the hub and also attaches to the hub via a lock or snap-in-place mechanism. This is a labor-intensive task for the user and many users do not like having to place their hands underneath a cleaning head assembly.

It would be desirable to provide a cleaning head assembly that has a pad driver that aligns and attaches to a cleaning head assembly component, such as a hub, in a touch-free manner.

SUMMARY

Certain embodiments of the present invention are described in the following numbered illustrative embodiments. Embodiments for a cleaning head assembly having touch-free attachment and alignment technology are disclosed. The assembly includes a hub (or cleaning head housing) and a pad driver, wherein the pad driver attaches and aligns to the hub (or cleaning head housing) using a magnetic coupling system and an aligning system. The pad driver attaches to and aligns axially with the hub (or cleaning head housing) in a touch-free manner. The hub also has teeth that engage or mate with teeth on the pad driver to help transmit torque from the hub to the pad driver.

In certain embodiments, the pad driver includes one or more magnets and the hub includes a ferromagnetic material, wherein the one or more magnets attract to the ferromagnetic material. Alternatively, the hub includes one or more magnets and the pad driver includes the ferromagnetic material. The ferromagnetic material can be a ring of ferromagnetic material. In some cases, the one or more magnets attract to the ferromagnetic material when the ferromagnetic material is deactivated and repel from the ferromagnetic material when the ferromagnetic material is activated.

Also, in some embodiments, the hub has a bottom surface that includes an axial aligning protrusion. The axial aligning protrusion can have a frustoconical shape terminating at a lowermost surface, wherein the lowermost surface has a diameter, and the pad driver has a pad driver opening having a diameter, wherein the lowermost surface diameter is smaller than the pad driver opening diameter.

In other embodiments, the pad driver has a top surface that includes an axial aligning protrusion, wherein the axial aligning protrusion has a frustoconical shape terminating at a topmost surface, wherein the topmost surface has a diameter, and the hub has a hub opening having a diameter, wherein the topmost surface diameter is smaller than the hub opening diameter.

In some embodiments, the hub has a top surface that includes an opening that receives a drive shaft and a bottom surface that has a plurality of hub heath. Also, the pad driver has a top surface that includes a plurality of pad driver teeth. The hub bottom surface is configured to magnetically attach to the pad driver top surface so that hub teeth engage with the pad driver teeth.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1:
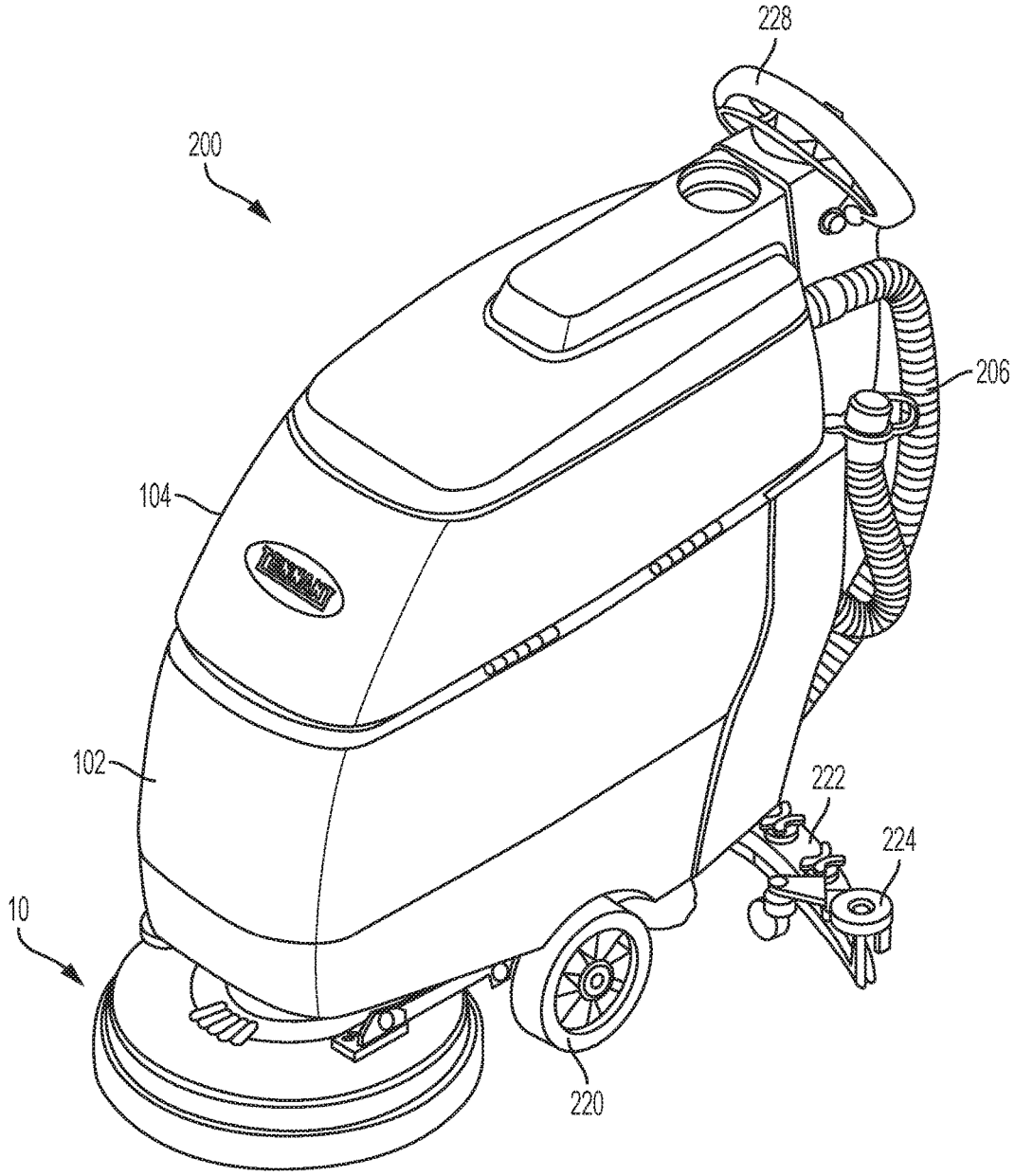
FIG. 1 is a perspective view of an exemplary floor surface maintenance machine employing a cleaning head assembly of the present invention.

FIG. 1 is a perspective view of an exemplary floor surface maintenance machine 200. In this example, the machine 200 is a walk-behind machine used to treat hard floor surfaces. Of course, in other examples, the machine can instead be a ride-on or towed-behind machine. Embodiments of the machine 200 include components that are supported on a motorized mobile body. The mobile body comprises a frame supported on wheels 220 for travel over a surface, on which a floor treating operation is to be performed. The mobile body includes operator controls and a steering wheel 228. The machine 200 can be powered by an on-board power source such as one or more batteries or an internal combustion engine. Alternately, the machine 200 can be powered through an electrical cord.

The machine 200 generally includes a base 202, that includes a frame, and a lid 204, which is attached along a side of the base 202 by hinges so that the lid 204 can be pivoted up to provide access to the interior of the base 202. The interior of the base 202 can also include a battery source and other electrical components of the machine 200. The base interior can also include a fluid source tank and a fluid recovery tank. The fluid source tank contains a fluid source such as a cleaner or sanitizing fluid that can be applied to the floor surface during treating operations. The fluid recovery tank holds recovered fluid source that has been applied to the floor surface and soiled.

The base 202 also includes a fluid recovery device 222, which includes a vacuum squeegee 224. The squeegee 224 is in vacuum communication with a fluid recovery tank. In operation, the squeegee 224 recovers soiled fluid from the floor surface and helps transport it to the recovery tank. The base 202 carries a cleaning head assembly 10 of the invention. The cleaning head assembly 10 can be attached to the base 202 such that the cleaning head 10 can be lowered to a cleaning position and raised to a traveling position. The cleaning head assembly 10 is interfaced with an existing machine using any known mechanism, such as a suspension and lift mechanism. The cleaning head assembly 10 includes one or more rotatable brushes, such as cylindrical scrub brushes. The brushes are held by a pad driver that, together with the brush, is detachable from a hub of the cleaning head assembly 10. In certain embodiments of the invention, the cleaning head assembly 10 includes a magnetic coupling system that allows for touch-free attachment and aligning between the pad driver and the hub.

In certain embodiments of the invention, the pad driver and the hub attach together using a magnetic coupling system. The hub has a bottom surface and the pad driver has a top surface. The hub bottom surface includes ferromagnetic material and the pad driver top surface includes one or more magnets that attract to the ferromagnetic material. Alternatively, the hub bottom surface includes the magnets and the pad driver top surface includes ferromagnetic material. In either case, when the pad driver and hub are brought into proximity to one another, the magnets pull the pad driver towards the hub and attach to the ferromagnetic material. This allows for attaching to occur in a touch-free manner.

pad driver and the hub also align together using an alignment system. As the magnets pull the pad driver towards the hub, the pad driver also self-aligns with the hub. The hub bottom surface includes an axial aligning protrusion that extends downwardly and aligns within an opening in the pad driver. The aligning protrusion has a lowermost surface that has a diameter that is smaller than the pad driver opening diameter. This causes the aligning protrusion to easily and somewhat automatically insert into the pad driver opening and to provide axial alignment between the hub and the pad driver. Alternatively, the pad driver top surface includes an axial aligning protrusion that extends upwardly and aligns within an opening in the hub. Here, the assigning protrusion has a topmost surface that has a diameter that is smaller than the hub opening diameter.

Additionally, the hub bottom surface includes a plurality of hub teeth and the pad driver top surface includes a plurality of pad driver teeth. The hub teeth and pad driver teeth mate or engage with one another. The aligning protrusion moves downward (or upward through the hub opening in alternate embodiments) through the pad driver opening until the pad driver teeth mate with the hub teeth. The meshing of the teeth provides rotational alignment between the hub and the pad driver. The pad driver is completely attached to the hub once the teeth are engaged and the magnets are contacting the ferromagnetic material. The bond between the magnets and ferromagnetic material is strong enough to withstand floor cleaning but weak enough to allow for easy removal of the pad driver from the hub. Additionally, engaged teeth allow for rotational torque to be easily transmitted from the hub to the pad driver. The engaged teeth also help to prevent torsional slippage during floor scrubbing in either a clockwise or counterclockwise direction.

Figure 2:
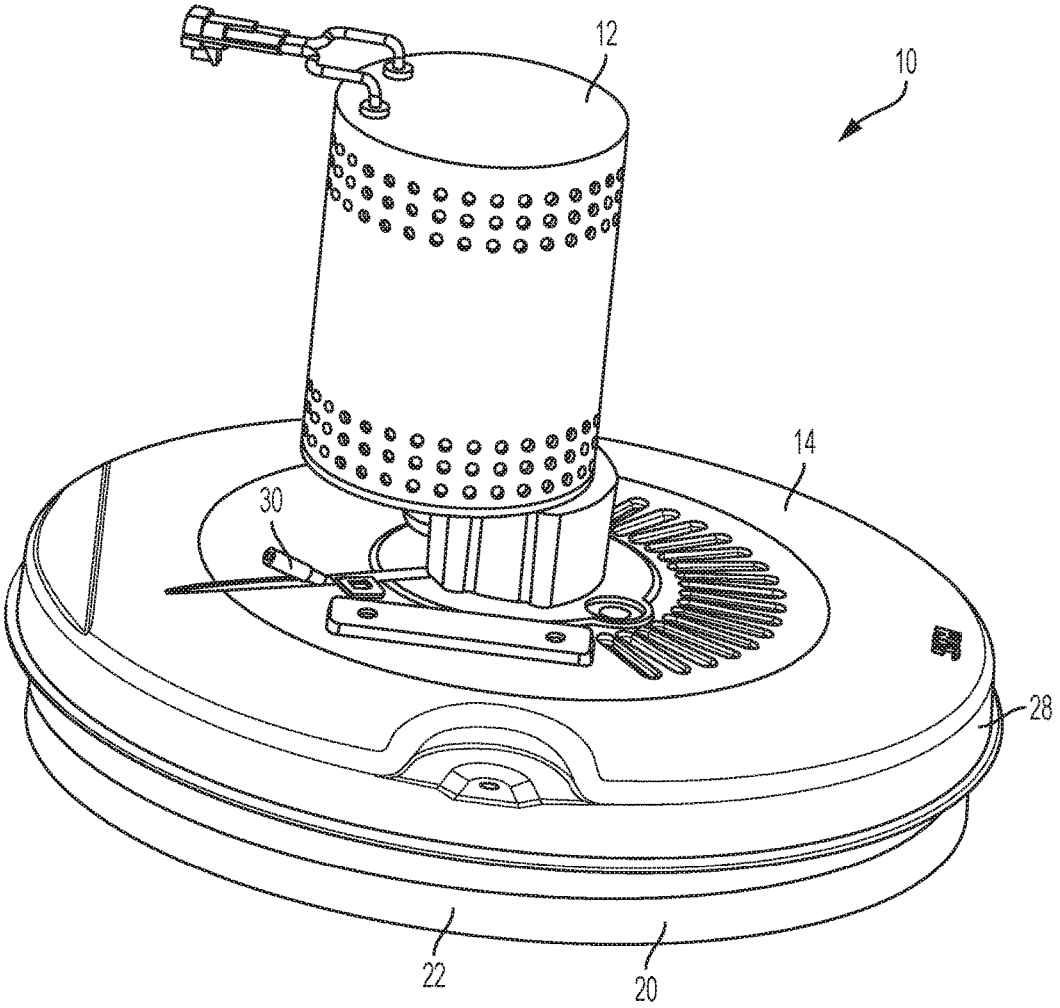
FIG. 2 is a perspective view of a cleaning head assembly according to one embodiment of the present invention.
Figure 3:
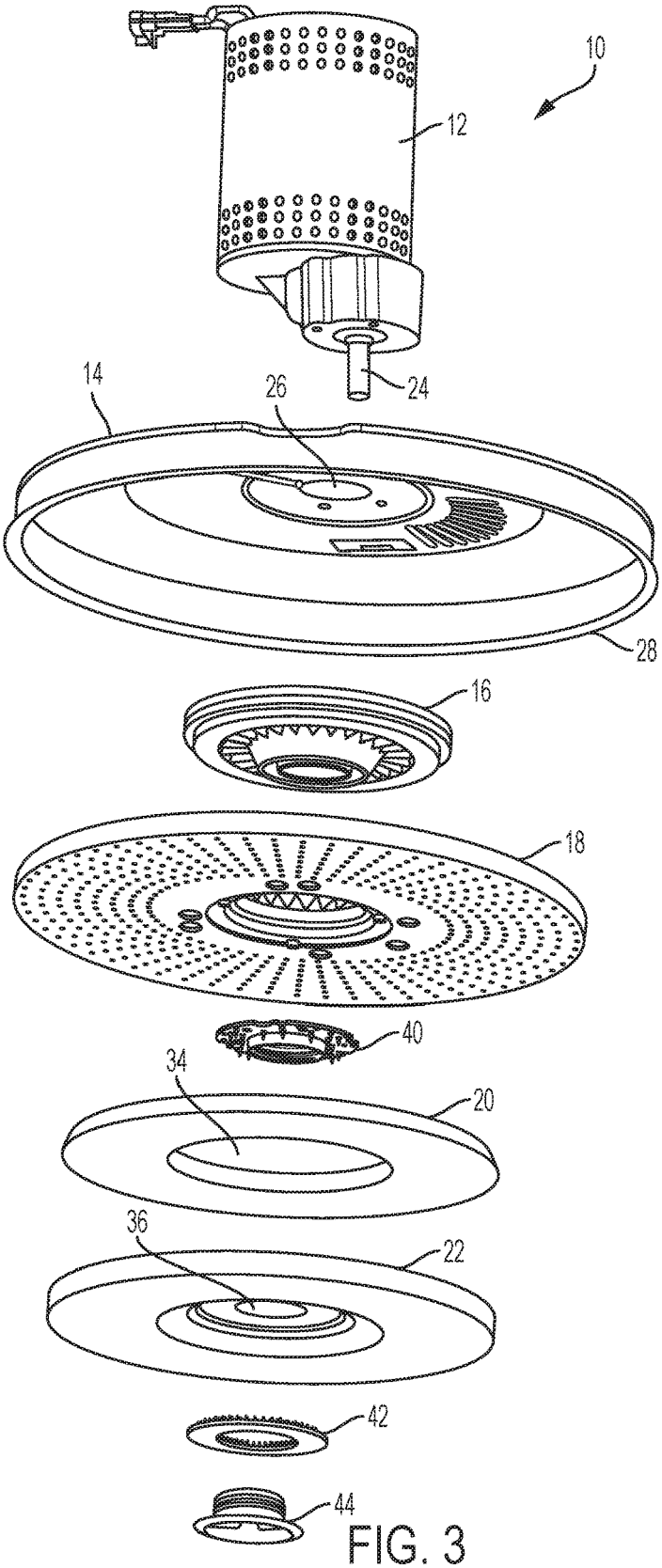
FIG. 3 is an exploded view showing components of the cleaning head assembly.

Certain exemplary embodiments of a cleaning head assembly 10 will now be described. FIG. 2 illustrates an assembled cleaning head assembly 10 whereas FIG. 3 illustrates an exploded cleaning head assembly. As shown, the cleaning head assembly 10 generally includes a motor 12, a deck 14, a hub 16, a pad driver 18, a bristle 20 and a pad 22. The motor 12 has a drive shaft 24 and in some cases the drive shaft is a keyed drive shaft. The motor 12 is fixedly mounted to the deck 14, and the deck 14 includes a deck opening 26 that receives the draft shaft 24. The deck 14 also has a skirt 28 that surrounds a periphery of the deck 14 and extends downward. A fluid dispersal tube 30 also extends through the deck opening 26.

The hub 16 has a hub opening 32 that also receives and fixedly engages the drive shaft 24. In cases where the motor drive shaft 24 is a keyed drive shaft, the hub opening 32 can also be a keyed opening that is configured to receive the keyed drive shaft. Thus, the motor drive shaft 24 first extends through the deck opening 26 and then inserts into and locks within the hub opening 32. As such, the motor 12, deck 14 and hub 16 are all locked or held in place together. Also, during operation, the motor 12 drives rotation of the drive shaft 24 which, in turn, drives rotation of the hub 16. The rotation may be in either a clockwise or counterclockwise direction. In some embodiments, a hub 16 may connect to a motorless hub via a belt, such that drive shaft 24 rotation of the hub 16 operates to connect via the motor 12 operates a belt drive that engages with and spins the hub. Motor 12 could also drive hub 16 via other methods known in the art. While one embodiment of attaching a hub 16 to a motor 12 is described, skilled artisans should understand that any known mechanism of driving rotation of a hub via a motor can be used.

Figure 4:
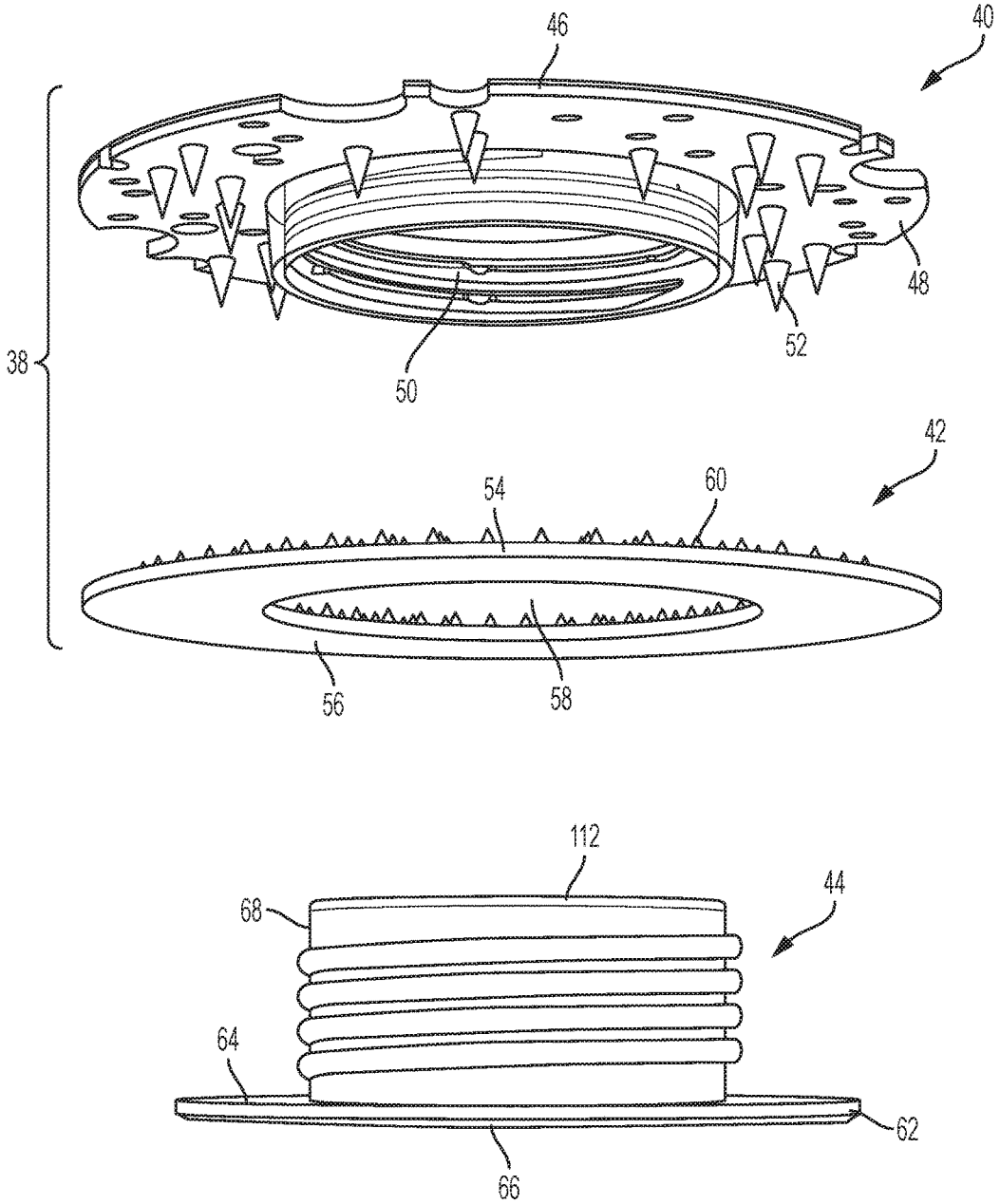
FIG. 4 is an exploded view of a pad holder that holds a pad onto a pad driver of the cleaning head assembly.

The pad driver 18 is located beneath the hub 16. An operator attaches a desired bristle 20 and pad 22 to the pad driver 18 using a pad holder assembly. In certain embodiments, the bristle 20 is included in the pad driver assembly. The bristle 20 has a bristle opening 34 and the pad 22 has a pad opening 36. FIG. 4 illustrates a pad holder assembly 38 according to one embodiment. The pad holder assembly 38 includes an upper washer 40, a lower washer 42 and a screw 44.

The upper washer 40 includes a top surface 46, a bottom surface 48 and an opening 50. As the opening extends downward, it defines a downwardly extending threaded protrusion 50. The threaded protrusion 50 is generally cylindrical shaped and is hollow in the center. The upper washer bottom surface 48 also includes one or more downward spikes 52 that extend downward and away from the bottom surface 48. The lower washer 42 includes a top surface 54, a bottom surface 56 and an opening 58. The lower washer top surface 54 also has upward spikes 60 that extend upward and away from the top surface 54.

The screw 44 includes a screw base 62 having a top surface 64 and a bottom surface 66. A threaded screw protrusion 68 extends upward and away from the screw base top surface 64. The threaded screw protrusion 68 can also have a hollow center that extends through an opening (not shown) on the screw base bottom surface 66. During use, one inserts the threaded screw protrusion 68 through the lower washer opening 58 so that the top surface 64 of the screw base 62 abuts the lower washer bottom surface 56. One then inserts the threaded screw protrusion 68 (and the attached lower washer 42) through the pad opening 36 and the bristle opening 34. Finally, one screws the threaded screw protrusion 68 onto the downward extending protrusion 50 on the upper washer 40.

Once the threaded screw protrusion 68 is engaged with the downward extending threaded protrusion 50, the bristle 20 and the pad 22 are held in place between the lower washer 42 and upper washer 40. The downward spikes 52 on the upper washer 40 engage with the bristle 20 whereas the upward spikes 60 on the lower washer 42 engage with the pad 22 to hold them in place. Thus, the pad driver 18, the bristle 20 and the pad 22 are held together using the pad holder assembly 38, and, together, form the pad driver assembly. While a particular embodiment of a pad holder assembly 38 has been described, skilled artisans should understand that any mechanism known in the art can be used to secure the pad driver 18 to pad 22, and to a bristle 20, when one is used.

Figure 5A:
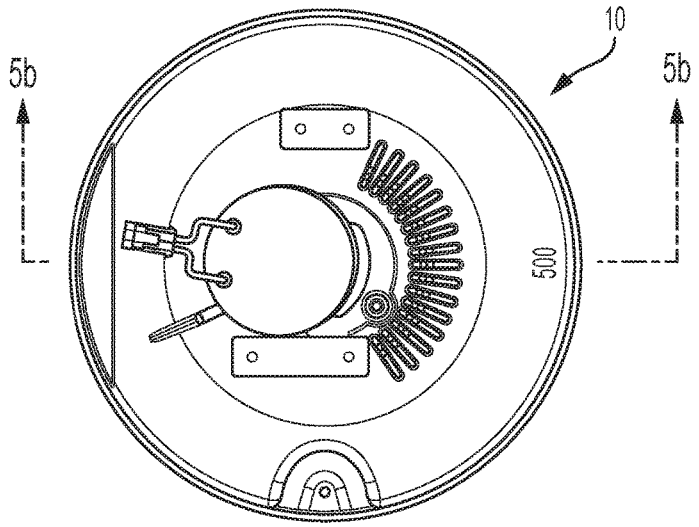
FIG. 5*a* is a top view of the cleaning head assembly.
Figure 5B:
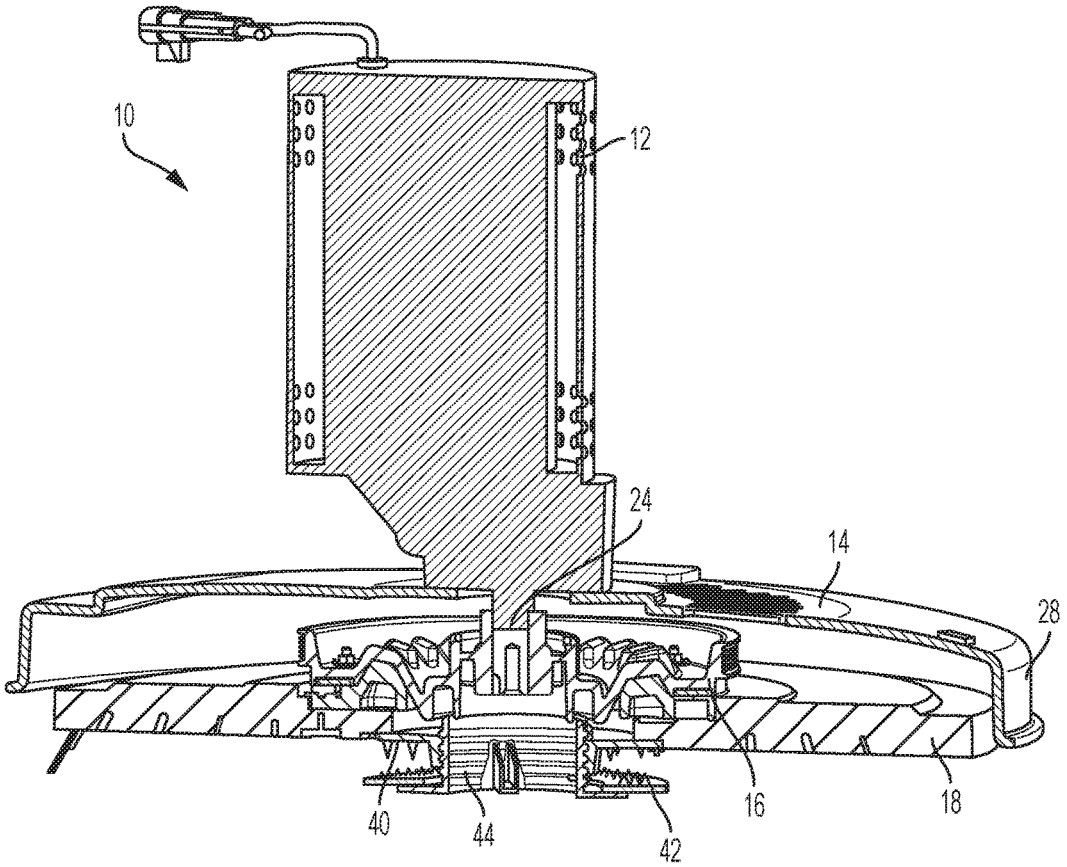
FIG. 5*b* is a cross-section view taken along section lines 5*b*-5*b* of FIG. 5*a;*

FIG. 5*b* illustrates a cross-section view of the cleaning head 10 in an assembled form (with the bristle 20 and the pad 22 omitted for clarity) taken generally along line 5*b*-5*b* in FIG. 5*a*. As shown, the motor 12 has a drive shaft 24 that is inserted through a deck opening 26 and locked into a drive shaft opening 70 on the hub 16. Thus, the motor 12, deck 14 and hub 16 are held or locked together. Also, the pad driver 18, the bristle 20 and the pad 22 are held together using the pad holder assembly 38, to form the pad driver assembly. The hub 16 (and thus the motor 12 and deck 14) couple to the pad driver 18 (and thus the bristle 20, the pad 22 and the pad holder assembly 38) in a touch-free manner using a magnetic coupling and self-aligning system, as will be described in more detail below.

FIGS. 6-8*b* illustrate a pad driver 18 according to one embodiment. The pad driver 18 includes a top surface 72, a bottom surface 74 and an opening 76 that extends entirely through the top surface 72 to the bottom surface 74. The pad driver 18 can have any desired size and shape and in the illustrated embodiment the pad driver has a circular shape. The pad driver 18 has an outer periphery 78 and a central opening 80.

The pad driver 18 includes a plurality of teeth 82 disposed on or part of the top surface 72. The plurality of teeth 82 can have any desired configuration or location, as long as the teeth 82 mate with corresponding teeth on the hub 16. In some cases, the teeth 82 have an angular shape. In other cases, the teeth 82 have a non-angular shape such as a lobed or circular shape. In the illustrated embodiment, the plurality of teeth 82 are in the form of a teeth ring. In certain embodiments, multiple teeth extend around the entire teeth ring without intervening gaps or spaces between each tooth. The teeth ring can be located anywhere on the top surface 72 between the outer periphery 78 and the central opening 80. In certain cases, as shown, the teeth ring directly surrounds the central opening 80.

The plurality of teeth 82 can be integral to the top surface 72 of the pad driver 18 or it can be a separate part or insert that is secured to a top surface 72 of the pad driver 18. In the illustrated embodiment, as best shown in FIG. 8*b*, the pad driver top surface 72 includes a recessed area 84 and the plurality of teeth 82 is an insert that is positioned and secured within the recessed area 84. In cases where the plurality of teeth is a teeth ring, the recessed area 84 is a ring that surrounds the pad driver opening 76. The teeth ring is an insert that has a size and shape that fits within the recessed area 84.

Figure 6:
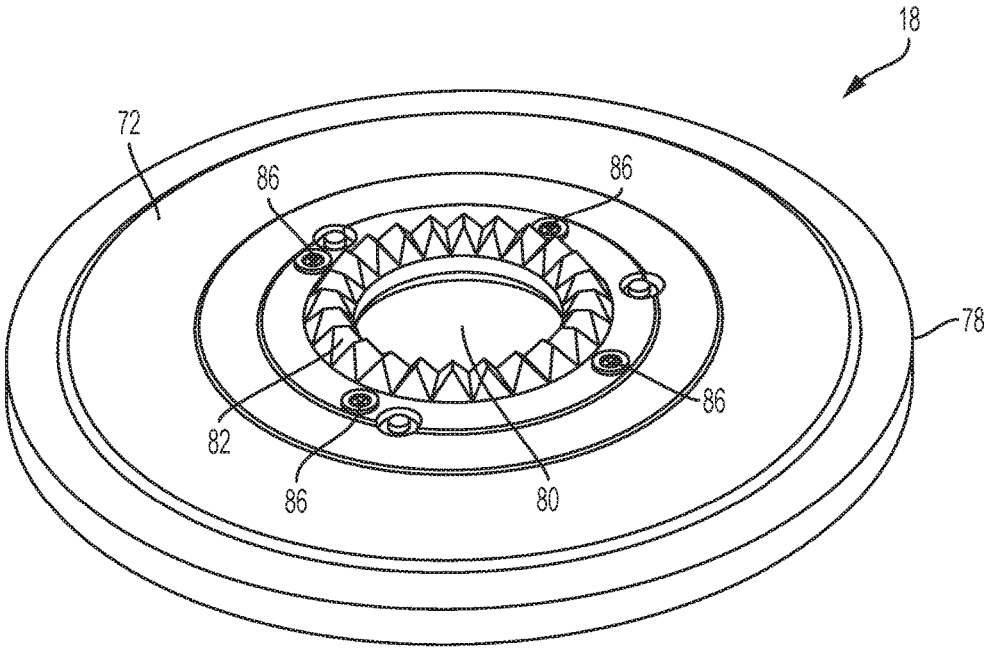
FIG. 6 is a perspective view of a top surface of a pad driver of the cleaning head assembly according to one embodiment.
Figure 7:
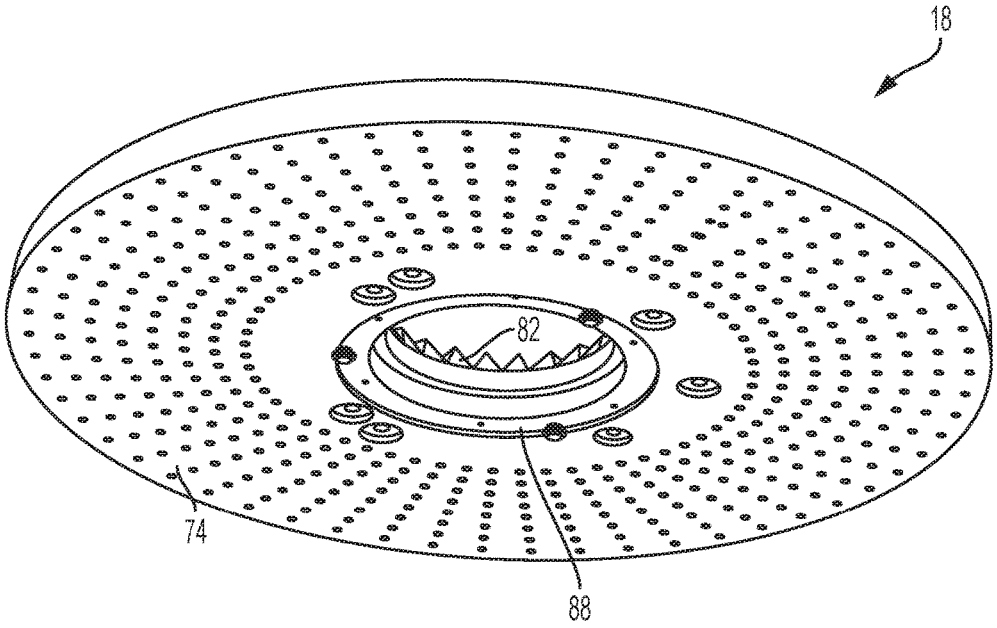
FIG. 7 is a perspective view of a bottom surface of the pad driver of FIG. 6.

The pad driver 18 also includes one or more magnets 86 (FIG. 6) disposed on the top surface 72. The magnets 86 can be positioned directly on the top surface or in cases where the plurality of teeth 82 is an insert, the magnets 86 can be positioned on the insert. In the illustrated case, as best shown in FIG. 6, four magnets 86 are positioned directly on a teeth ring insert, so that when the teeth ring insert is secured within the recessed area 84, the magnets 86 are also secured to the top surface 72. The magnets 86 are also positioned at a location that is between the teeth ring 82 and the outermost periphery 78, although this is not required. The magnets 86 can be positioned anywhere on the top surface 72 as long as they come into direct contact with a ferromagnetic material on the hub 16. Magnets 86 could also be formed from a magnetic ring that extends around the teeth ring 82.

Figure 8A:
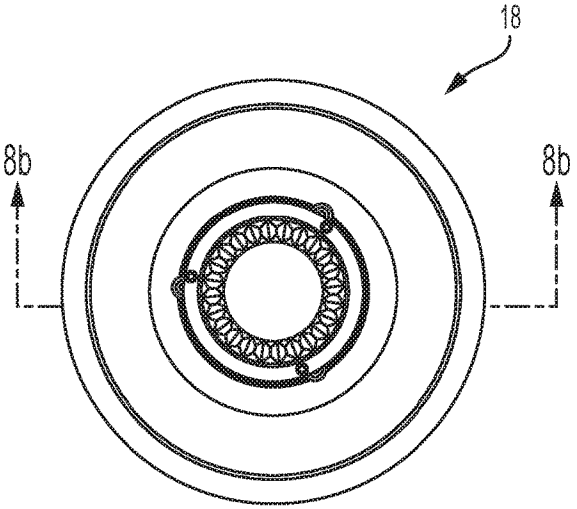
FIG. 8*a* is a top view of the pad driver.
Figure 8B:
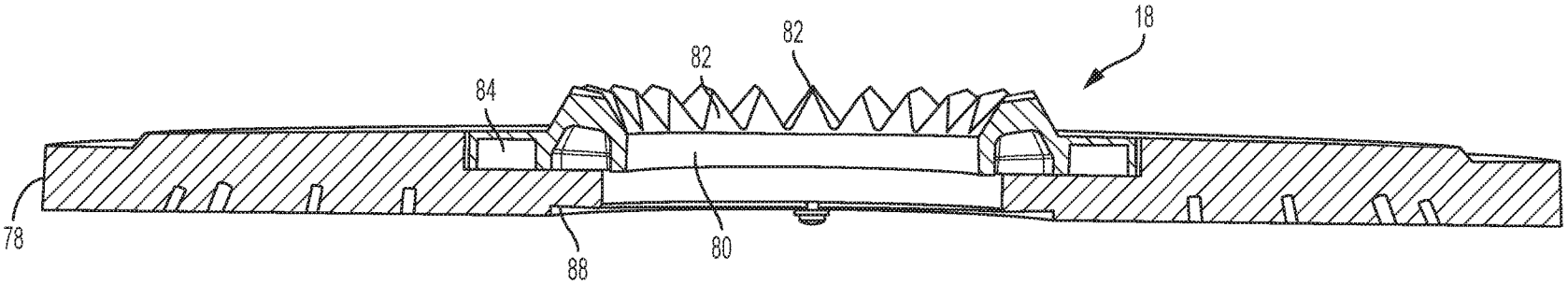
FIG. 8*b* is a cross-section view taken along section lines 8*b*-8*b* of FIG. 8*a;*
Figure 9:
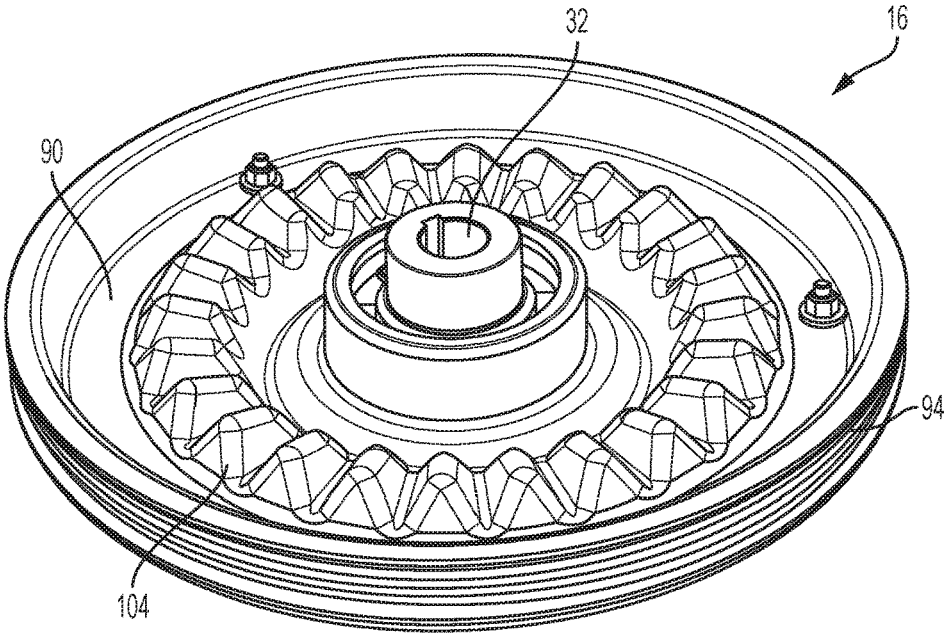
FIG. 9 is a perspective view of a top surface of the hub of the cleaning head assembly according to one embodiment.

FIG. 8*a* shows a top view of the pad driver 18. FIG. 8*b* provides a cross-sectional view of the pad driver 18 taken generally along line 8*b*-8*b* of FIG. 8*a*. As best shown in FIG. 8*b*, the pad driver bottom surface 74 includes a recessed area 88 that receives the top surface 46 of the upper washer 40 shown in FIG. 4. The upper washer top surface 46 is sized and shaped to fit within the recessed area 88. Here, the upper washer top surface 46 is circular shaped and the recessed area 88 is a recessed ring. Of course, the upper washer top surface 46 and the recessed area 88 can have any desired size and shape. The upper washer top surface 46 can also be secured to the recessed area 88 using any known attachment mechanism.

FIGS. 9-11*b* illustrate a hub 16 according to one embodiment. The hub 16 includes a top surface 90, a bottom surface 92 and an opening 32 that extends entirely through the top surface 90 to the bottom surface 92. As already explained above, the hub opening 32 is configured as a drive shaft opening that receives a motor drive shaft 24. The hub 16 can have any desired size and shape and in the illustrated embodiment the hub has a circular shape. The hub 16 has an outermost periphery 94. In some embodiments, the outermost periphery 94 defines a surface that receives a belt drive, although this is certainly not required.

Figure 10:
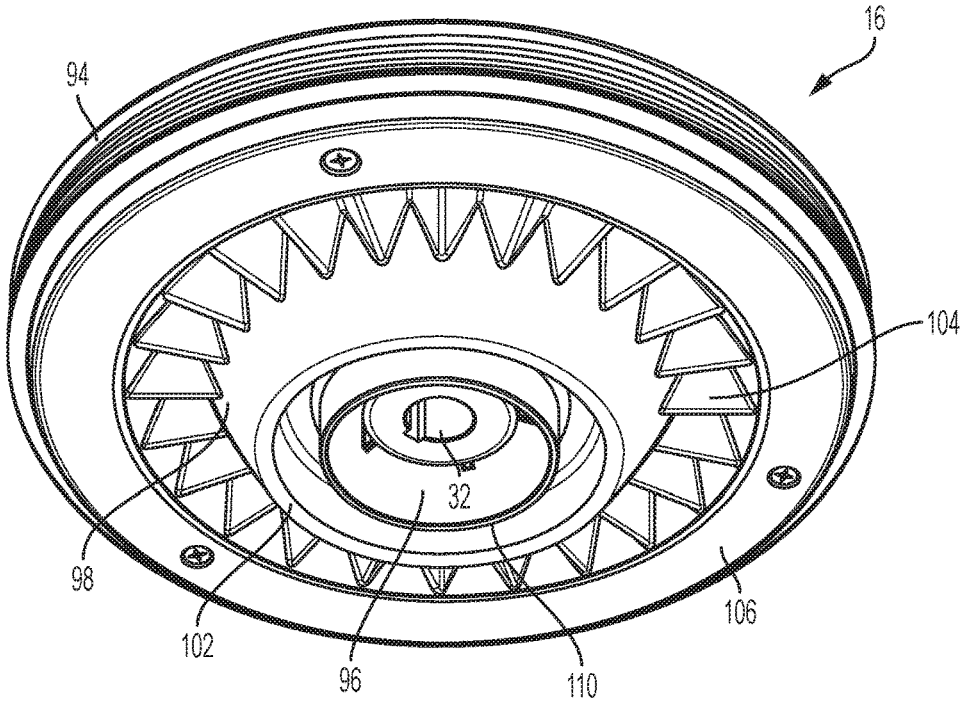
FIG. 10 is a perspective view of a bottom surface of the hub of FIG. 9.

The hub bottom surface 92 includes a cylindrical protrusion 96 and an axial alignment protrusion 98. As best shown in FIG. 10, the cylindrical protrusion 96 is positioned in between the hub opening 32 and the aligning protrusion 98. In other words, the cylindrical protrusion 96 surrounds the hub opening 32 and is surrounded by the axial alignment protrusion 98. In the illustrated embodiment, the cylindrical protrusion 96 has a circular cross-section and the axial alignment protrusion 98 has a conical or frustoconical shape.

Figure 11A:
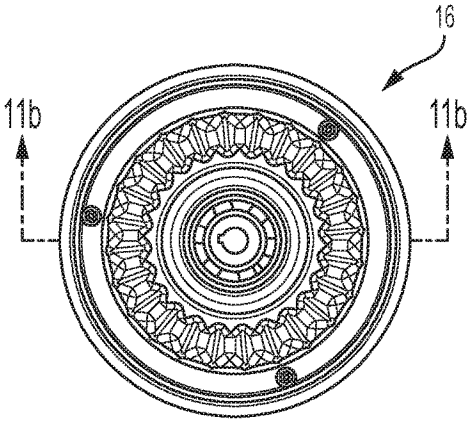
FIG. 11*a* is a top view of the hub of FIG. 9.
Figure 11B:
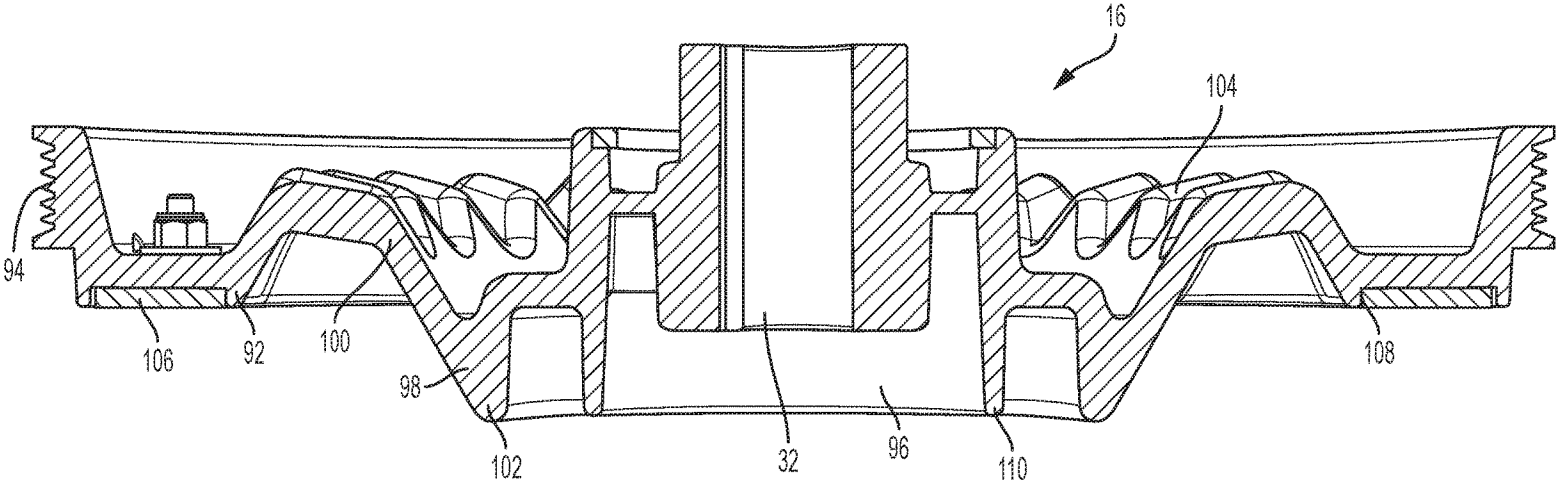
FIG. 11*b* is a cross-section view taken along section lines 11*b*-11*b* of FIG. 11*a;*

FIG. 11*a* shows a top view of the hub 16. FIG. 11*b* provides a cross-sectional view of the hub 16 taken generally along line 11*b*-11*b* of FIG. 11*a*. FIG. 11*b* best illustrates the axial alignment protrusion 98. The axial alignment protrusion 98 has an upper surface 100 and the lowermost surface 102. The upper surface 100 has a diameter that is larger than a diameter of the lowermost surface 102. The axial alignment protrusion 98 has a conical or a frustoconical shape that extends downward from the upper surface 100 and ends at the lowermost surface 102. The lowermost surface 102 also forms a lowermost surface of the axial alignment protrusion 98. As the axial alignment protrusion 98 extends downwardly its diameter continuously decreases until the lowermost surface 102 is reached.

Referring back to FIG. 6, the pad driver 18 has a central opening 80. The central opening 80 has a diameter that is larger than a diameter of the axial aligning protrusion lowermost surface 102. In some cases, the pad driver central opening 80 is equal to or at least 0.5 inch or perhaps equal to or at least 1 inch larger in diameter than the axial aligning protrusion lowermost surface 102. This difference in diameter allows the aligning protrusion lowermost surface to easily guide into the pad driver opening 76. Also, the pad driver opening 80 has a diameter that is substantially the same as or substantially similar to the diameter of the upper surface of the axial aligning protrusion 98. Skilled artisans will understand that the hub bottom surface 92 can have any other configuration that allows the bottom surface to easily align axially to the upper surface of the pad driver 18.

The hub 16 includes a plurality of teeth 104 disposed on or part of the hub bottom surface 92. The plurality of hub teeth 104 can have any desired configuration or location as long as the teeth mate with corresponding teeth 82 of the pad driver. In some cases, the teeth 104 have an angular shape. In other cases, the teeth 104 have a non-angular shape such as a lobed or circular shape. In the illustrated embodiment, as best shown in FIG. 10, the plurality of teeth 104 is in the form of a teeth ring. The teeth ring can be located anywhere on the hub bottom surface 92 so long as the teeth align with the pad driver teeth 82. In certain cases, as shown, the teeth ring 104 directly surrounds the axial alignment protrusion 98. The plurality of hub teeth 104 can be integral to the hub bottom surface 92 or it can be a separate part or insert that is secured to the hub bottom surface 92. In the illustrated embodiment, as best shown in FIG. 10*b*, the hub teeth are integral to or part of the hub bottom surface 92. Also, as shown, the hub teeth can also form a portion of the axial alignment protrusion 98.

The hub 16 also includes a ferromagnetic material 106 disposed on the hub bottom surface 92, as best shown in FIG. 10. The entire hub body can be a ferromagnetic material, only the bottom surface 92 is a ferromagnetic material or the ferromagnetic material can be provided as an insert that attaches to the hub bottom surface 92. In the illustrated case, as best shown in FIG. 11*b*, the hub bottom surface 92 has a recessed ring 108 and the ferromagnetic material is a ring 106 that is positioned and secured within the recessed ring 108. The ferromagnetic ring 106 is shown as being positioned at a location that is between the hub teeth ring 104 and the hub outermost periphery 94, although this is not required. The ferromagnetic ring 106 need only be positioned on the hub bottom surface 92 so that it comes into direct contact with the one or more magnets 86 on the pad driver top surface 72.

The ferromagnetic material 106 can be any ferromagnetic material known in the art. In other cases, this material can be any other material that attracts a magnet. In certain embodiments, the magnet(s) 86 and magnetic material 106 is selected so that when they are combined, they are capable of holding at least 50 pounds, at least 75 pounds, at least 100 pounds, or at least 125 pounds of force. In certain cases, when the hub 16 and/or pad driver 18 has an overall diameter of between 18-22 inches, such as 20 inches, then the combined magnet(s) 86 and magnetic material 106 are capable of holding at least 100 pounds of force. In other cases, when the hub 16 and/or pad driver 18 has an overall diameter of between 10-14 inches, the combined magnets (86) and magnets material are capable of holding at least 50 pounds of force. Applicant has discovered that by using such a large force, the pad driver 18 more easily attracts to and self-aligns with the hub 16. Likewise, the strong force helps maintain the pad driver 18 onto the hub 16 during rough operating conditions, such as when the cleaning head 10 moves over bumps or grooves on the floor surface.

The pad driver teeth 82 and the hub teeth 104 can have any configuration such that they mate together and remain mated during machine operation. As the hub 16 rotates clockwise or counterclockwise, the pad driver 18 also rotates. The mated teeth allow torque to be transmitted from the hub 16 into the pad driver 18. The mated teeth also help prevent torsional slippage during rotation. The teeth 82, 104 can have an angular shape or a non-angular shape such as a lobed or circular shape. In certain cases, the pad driver teeth 82 and the hub teeth 104 are each at least ⅛ inch tall, such as ¼ inch tall, as ½ inch or perhaps 1 inch tall. In some cases, the teeth 82, 104 are between ⅛ inch and 1½ inches tall or between 5 mm and 35 mm tall. In certain cases, the teeth 82, 104 are between ¼ inch and 1 inch tall, such as between ½ inch and 1 inch tall. Also, in certain embodiments, the pad driver teeth 82 and the hub teeth 104 each include between 16-40 teeth, perhaps between 20-30 teeth, such as 24 teeth each (or between 32-80 teeth combined, perhaps between 40-60 teeth combined, such as 48 teeth combined). Finally, in certain cases, the pad driver teeth 82 and the hub teeth 104 are positioned at between 30-90 angles between each tooth, such as at a 45°, 60° or 80° angle. In the embodiment of FIGS. 6-13*b*, the teeth are positioned at 60° angles between each tooth. In the embodiment of FIGS. 14*a*-22*b*, the teeth are positioned at 80° angles between each tooth. Applicant has discovered that when the teeth 82, 104 have the above listed dimensions, they are particularly effective at easily aligning together while also preventing torsional slippage during rotation.

Figure 12:
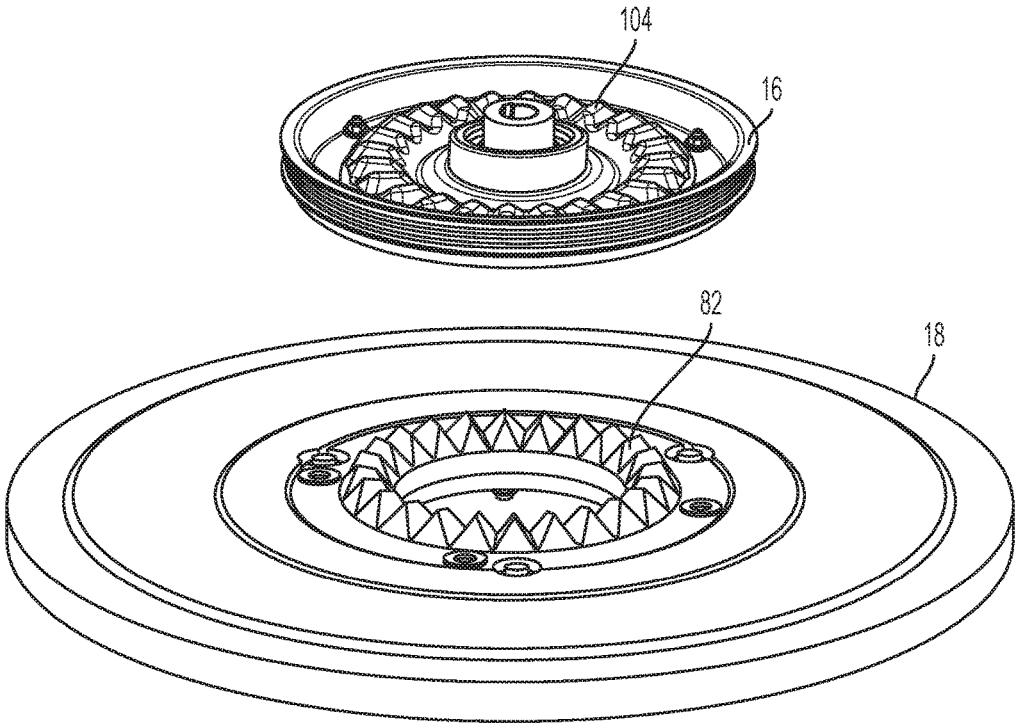
FIG. 12 is a perspective view of a hub and pad driver combination according to one embodiment.

FIG. 12 illustrates the arrangement of the hub 16 and pad driver 18 during touch-free attachment and alignment. The hub 16 and the pad driver 18 are configured so that when they attach together, the pad driver teeth 82 mate with the tub teeth 104 and provide rotational alignment. In certain embodiments, the leading surfaces of the teeth are formed in sharp edges such that leading surface of one of the pad driver teeth 82 slip past the leading surface of one of the tub teeth 104, providing a relative rotational movement as the teeth mate together. Likewise, the one or more magnets 86 on the pad driver top surface 72 directly contact the ferromagnetic ring 106 on the hub bottom surface 92. Again, the pad driver inner opening 80 has a larger diameter than the diameter of the lowermost surface 102 of the axial aligning protrusion.

During use, an operator simply positions the surface maintenance machine 200 so that the cleaning head assembly 10 is positioned over a pad driver 18 (that is perhaps lying on the floor). The magnets 86 attract to the ferromagnetic ring 106, thus moving the pad driver 18 closer to the hub 16. As the pad driver 18 moves closer to the hub 16, the lowermost surface 102 of the hub axial alignment protrusion 98 self-guides into the pad driver opening 80. Again, this self-guiding occurs because the frustoconical shape of the axial aligning protrusion 98. The smaller diameter of the lowermost surface 102 enters into the larger opening 80 diameter. As the aligning protrusion moves through the opening 80, the frustoconical shape causes the pad driver 18 and hub 16 to axially self-align.

The pad driver 18 continues upward until the pad driver teeth 82 engage with the hub teeth 104. The pad driver teeth 82 have a topmost surface 116 that engage with the hub 104 to cause rotational alignment of the hub 16 and pad driver 18 in either a clockwise or counterclockwise direction until the teeth rotate in place and become directly mated together. Once the teeth are mated together, the magnets 86 also contact the ferromagnetic material 106. Thus, this entire axial aligning, rotational aligning and attaching process can be performed in a touch-less manner. An operator simply moves the cleaning head assembly 10 over a pad driver 18 and the pad driver 18 automatically attaches to and aligns to the hub 16.

Figure 13A:
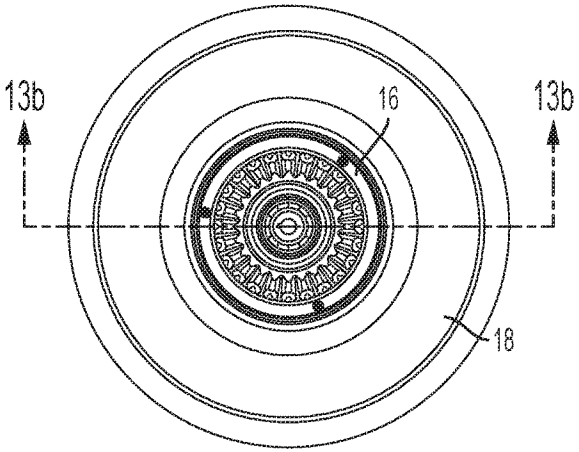
FIG. 13*a* is a top view of the hub and pad driver combination of FIG. 12.
Figure 13B:
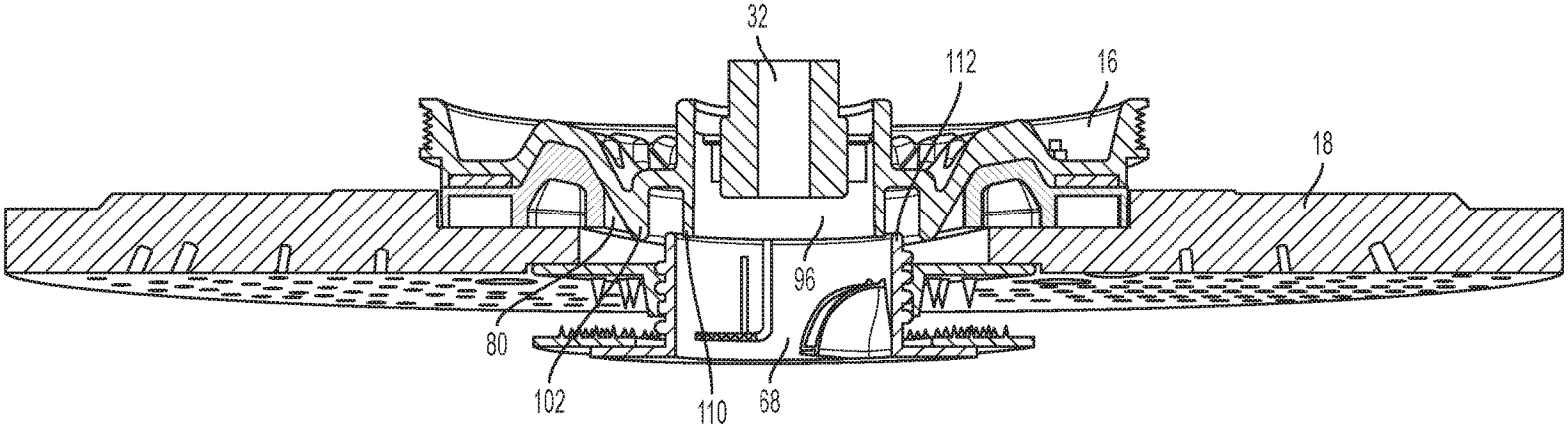
FIG. 13*b* is a cross-section view taken along section lines 13*b*-13*b* of FIG. 13*a*.

FIG. 13*b* is a cross-section view of the pad driver 18 attached to the hub 16. As shown, when the pad driver 18 and the hub 16 are attached together, the pad driver teeth 82 insert into and mate with the hub teeth 104. Also, the cylindrical protrusion 96 has a lowermost surface 110 that extends below a topmost surface 112 of the threaded screw protrusion 68. The fluid dispersal tube 30 disperses fluid into the cylindrical protrusion 96, which then enters the threaded screw protrusion 68 and exits the screw via a hole (not shown) on the screw base 62. Once the fluid exits the screw base 62, it is deposited onto the floor surface. Since the center protrusion lowermost surface 110 extends below the threaded screw protrusion topmost surface 112, the dispersed water is confined to space inside the cylindrical protrusion 96 and screw 44 and does not seep into any other components of the hub 16 or pad driver 18.

Figure 24:
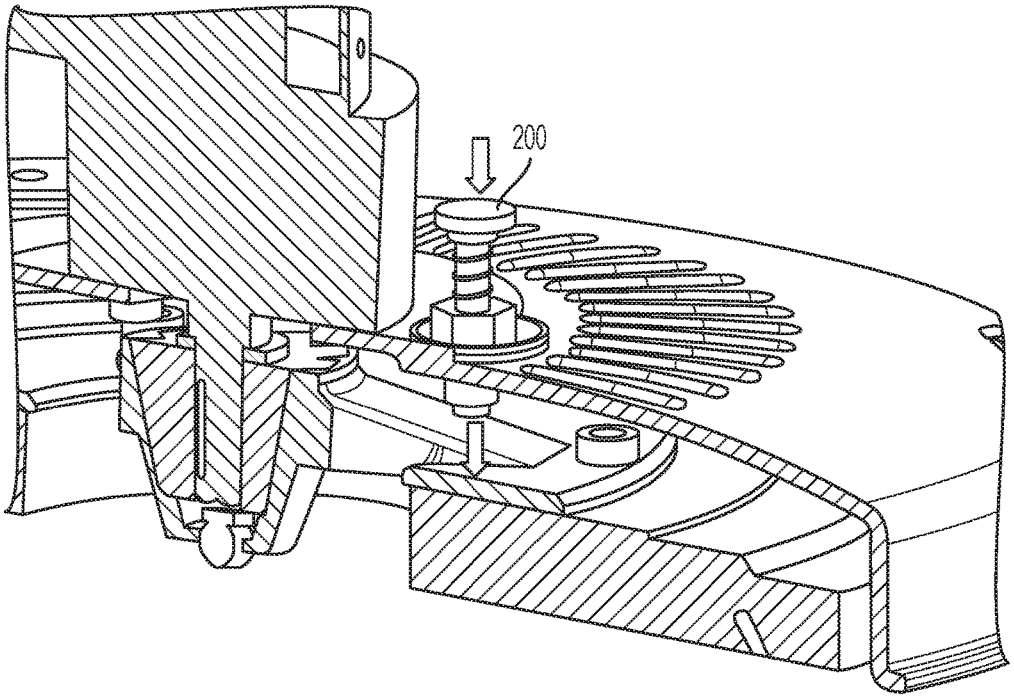
FIG. 24 is a perspective view of a device on a hub that applies downward force to a pad driver.

When it is desired to remove the pad driver 18 from the hub 16, an operator simply breaks the magnetic bond between the magnet(s) 86 and ferromagnetic material 106. In certain cases, the cleaning head assembly 10 includes a device that when triggered, places downward force on the pad driver 18, thereby breaking the bond. In one embodiment, the deck 14 includes a foot pedal and an operator simply steps on the foot pedal, which places downward force on the pad driver 18. In another embodiment, the deck 14 includes a hand bottom and an operator pushes the button to place downward force on the pad driver 18. The foot pedal or push button can have any desired configuration in the art that is capable of applying downward force to the pad driver. In some cases, as shown in FIG. 24, the foot pedal or push button includes a spring or other biasing mechanism that biases upwardly. In other embodiments, when it is desired to remove the pad driver 18 from the hub 16, an operator activates the ferromagnetic material 106 to cause the ferromagnetic material 106 to repel the magnet(s) 86. Any system of activating ferromagnetic material can be used to activate the ferromagnetic material 106.

In the embodiments of FIGS. 6-13*b*, the magnets 86 are positioned on a pad driver 18 and the ferromagnetic material 106 is positioned on the hub 16, although this is not required. Alternatively, the ferromagnetic material 106 can be positioned on or integral to the pad driver 18 and the magnets 86 can be positioned on the hub 16. Additionally, in the embodiments of FIGS. 6-13*b*, the pad driver teeth 82 are male components and the hub teeth 104 are female components, so that the pad driver male teeth 82 insert into the female hub teeth 104. Alternatively, as shown in the embodiments of FIGS. 14*a*-22*b*, the hub teeth 104 are male components and the pad driver teeth 82 are female components, so that the male hub teeth 104 insert into the female pad driver teeth 82.

Also, in the embodiments of FIGS. 6-13*b*, the axial aligning protrusion 98 is positioned on the hub 16. Alternatively, the aligning protrusion 98 can instead be positioned on the pad driver 18, such that a topmost surface of the aligning protrusion extends through an opening on the hub. Finally, in the embodiments of FIGS. 6-13*b*, the ferromagnetic material 106 is positioned on the hub. Alternatively, the ferromagnetic material 106 can be positioned elsewhere on the cleaning head assembly, such as on a deck. Likewise, the hub part can be integral to another component to the cleaning head assembly. The ferromagnetic material 106 need only be positioned on a component of the cleaning head assembly such that it aligns with the magnets(s) 86 on the pad driver.

Figure 14A:
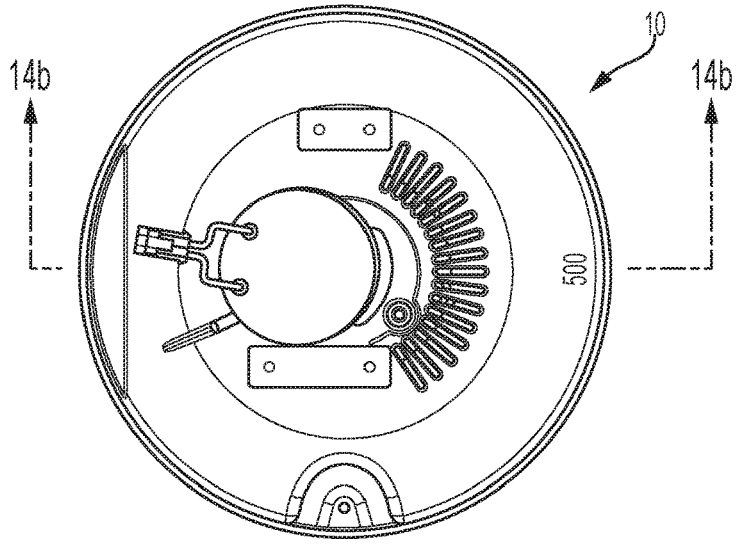
FIG. 14*a* is a top view of a cleaning head assembly according to another embodiment.
Figure 14B:
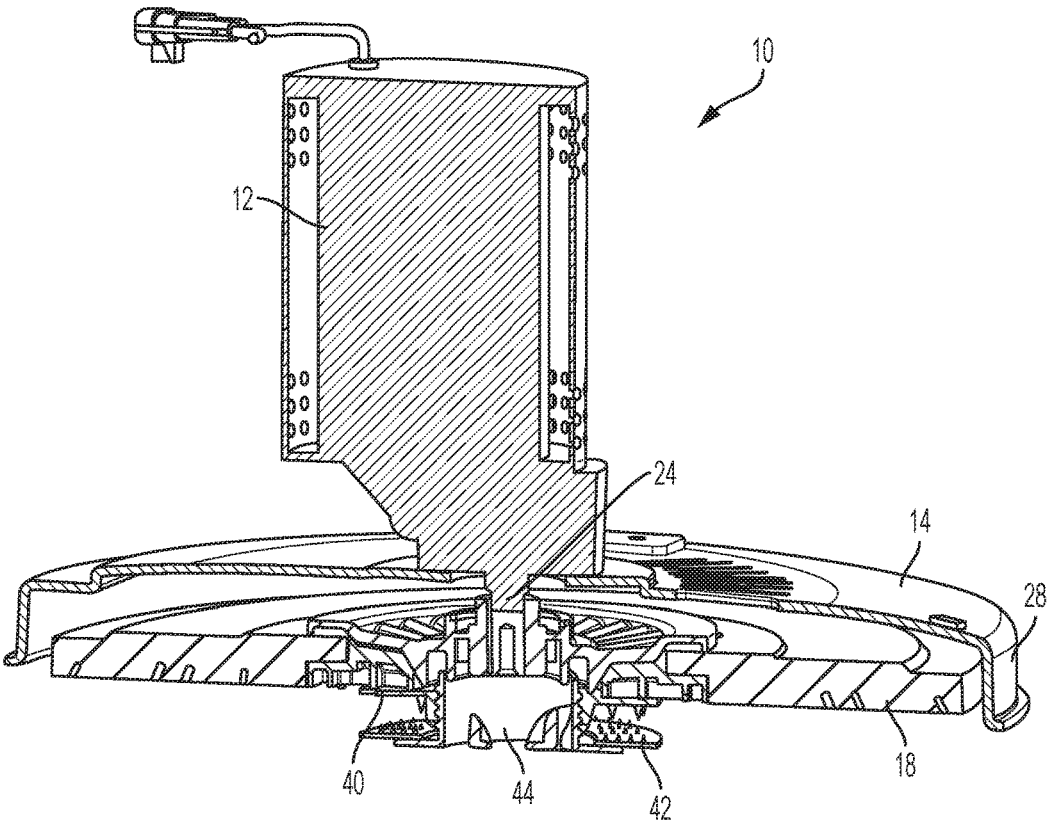
FIG. 14*b* is a cross-section view of the cleaning head assembly of FIG. 14*a;*
Figure 15:
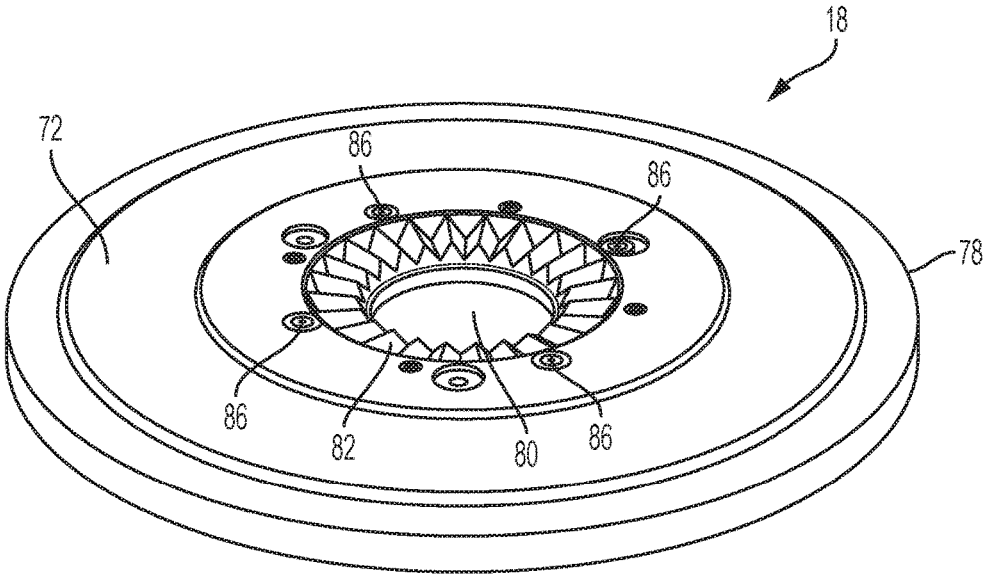
FIG. 15 is a perspective view of a top surface of a pad driver of a cleaning head assembly according to one embodiment.
Figure 16:
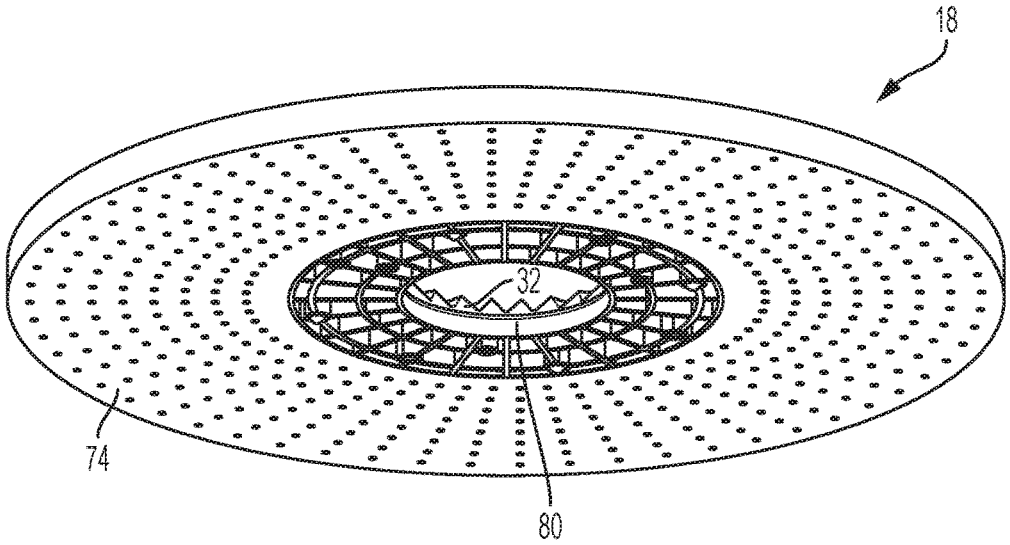
FIG. 16 is a lower perspective view of a bottom surface of the pad driver of FIG. 15.
Figure 17A:
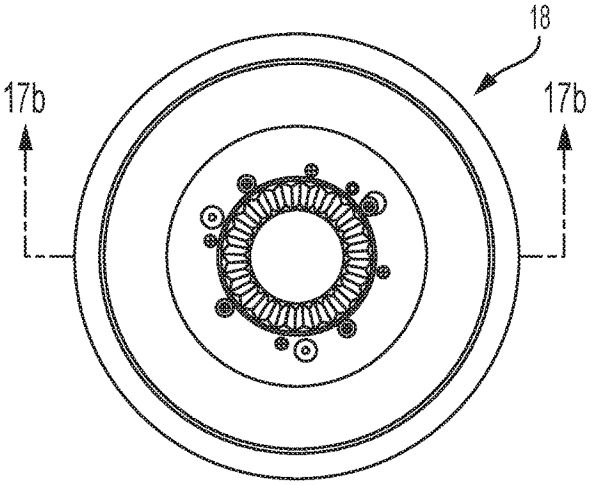
FIG. 17*a* is a top view of the pad driver of FIG. 15.
Figure 17B:
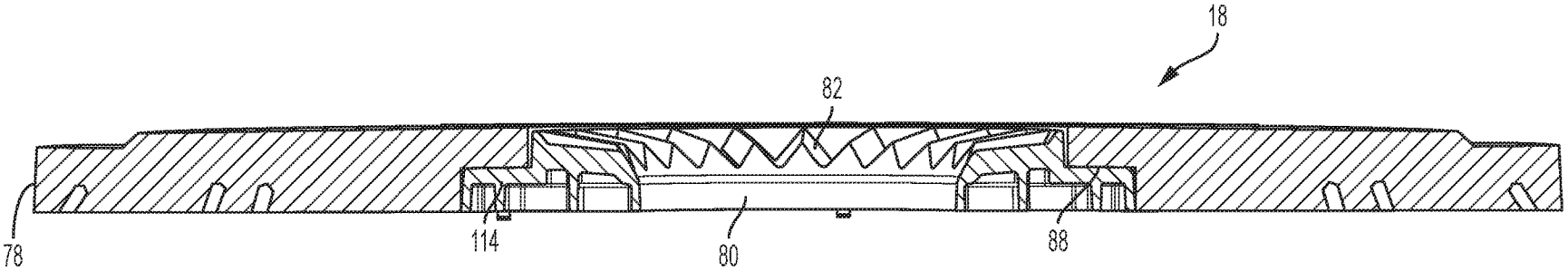
FIG. 17*b* is a cross-section view taken along section lines 17*b*-17*b* of FIG. 17*a;*
Figure 18:
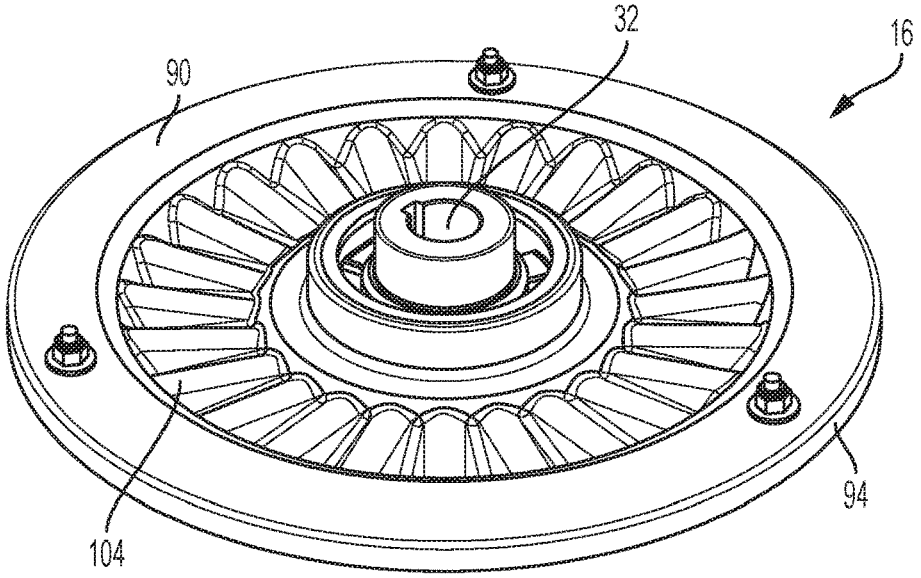
FIG. 18 is a perspective view of a top surface of a hub of a cleaning head assembly according to one embodiment.
Figure 19:
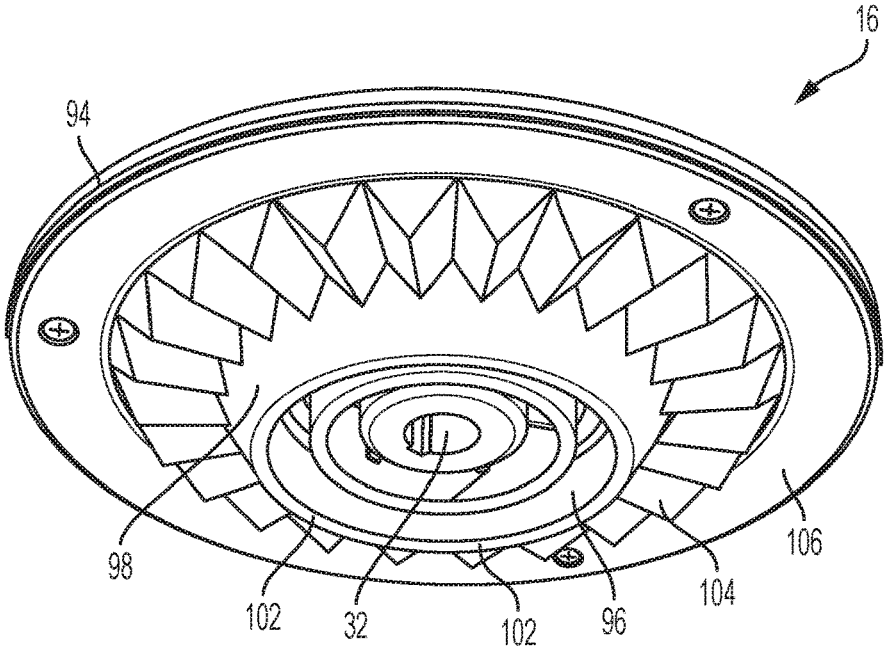
FIG. 19 is a perspective view of a bottom surface of the hub of FIG. 18.
Figure 20A:
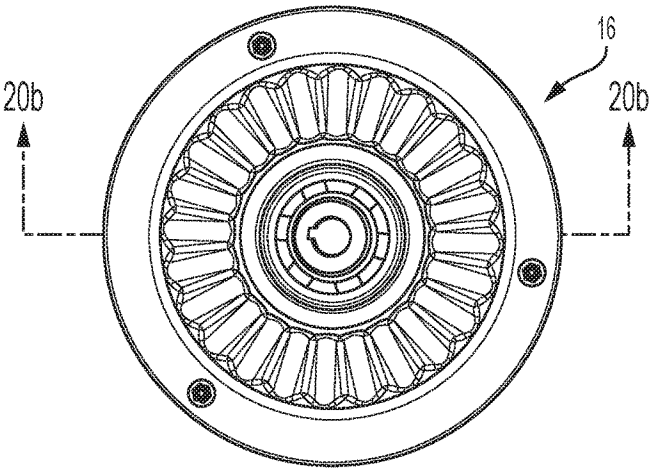
FIG. 20*a* is a top view of the hub of FIG. 18.
Figure 20B:
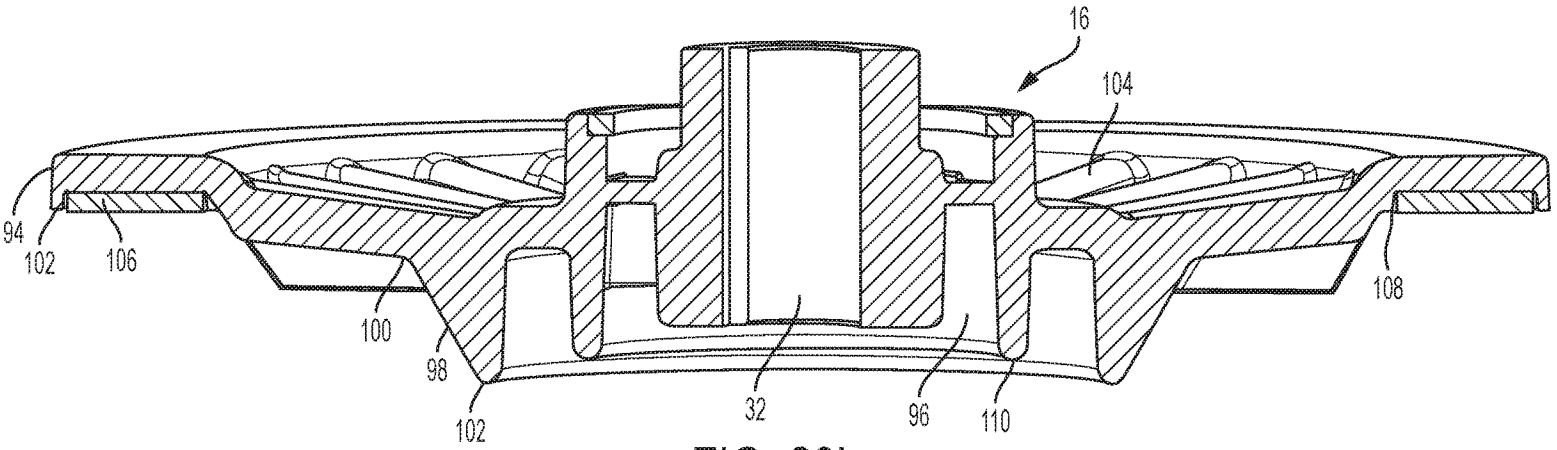
FIG. 20*b* is a cross-section view taken along section lines 20*b*-20*b* of FIG. 20*a;*
Figure 21:
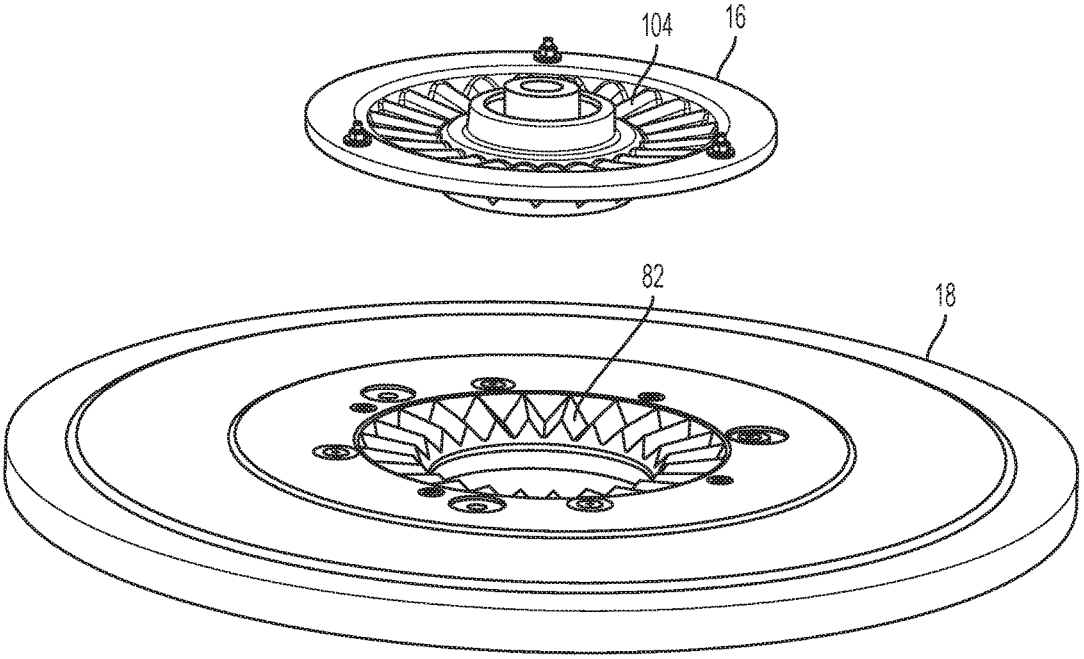
FIG. 21 is a perspective view of a hub and pad driver combination according to one embodiment.
Figure 22A:
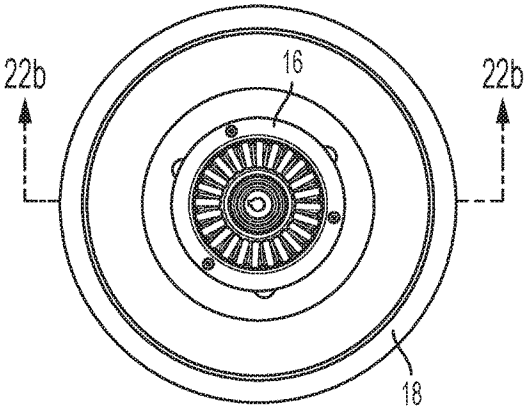
FIG. 22*a* is a top view of the hub and pad driver combination of FIG. 21.
Figure 22B:
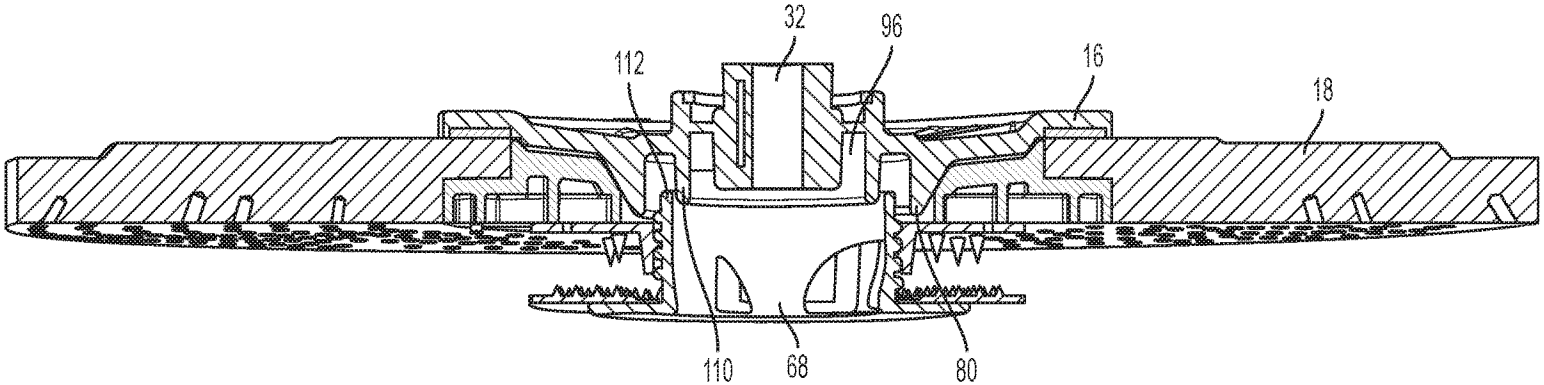
FIG. 22*b* is a cross-section view taken along section lines 22*b*-22*b* of FIGS. 22*a*.

FIGS. 14*a*-22*b* illustrate a pad driver 18 and hub 16 according to another embodiment. The features (and reference numerals) already described for the embodiment in FIGS. 6-13*b* also apply to the embodiment of FIGS. 14*a*-22*b*. As shown in FIGS. 14*a*-16*b*, the pad driver of this embodiment is similar to the pad driver of the embodiment of FIGS. 6-8*b*, with a few differences. First, with best reference to FIG. 16*b*, the pad driver bottom surface 76 includes a recessed area 88 and the plurality of teeth 82 is a teeth ring insert that fits within this recessed area 88. The teeth ring insert 82 has an outer shoulder 114 that abuts the recessed area 88. Thus, the teeth ring 82 in this embodiment is positioned in place about the pad driver bottom surface 76 rather than the pad driver top surface 72. Once the teeth ring insert 82 is fitted within the recessed area 88, the teeth ring presents on the pad driver top surface 72, as shown in FIG. 14. Also, the one or more magnets 86 are positioned on the pad driver top surface 72 itself rather than being positioned on the insert 82.

FIGS. 17-19*b* illustrate a hub 16 according to one embodiment. The hub of this embodiment is similar to the hub of the embodiment of FIGS. 9-11*b*, with a few differences. First, in the embodiment FIGS. 9-11*b*, the hub outermost periphery 94 defines a surface that receives a belt drive whereas in the embodiment 17-19*b*, the hub outermost periphery 94 does not receive a belt drive. Also, the hub teeth 104 are male components rather than female components, such that the male hub teeth 104 insert into and are received by the female pad driver teeth 82. Finally, the teeth 82, 104 are positioned at between 80° angles between each tooth rather than at 60° angles.

Figure 23:
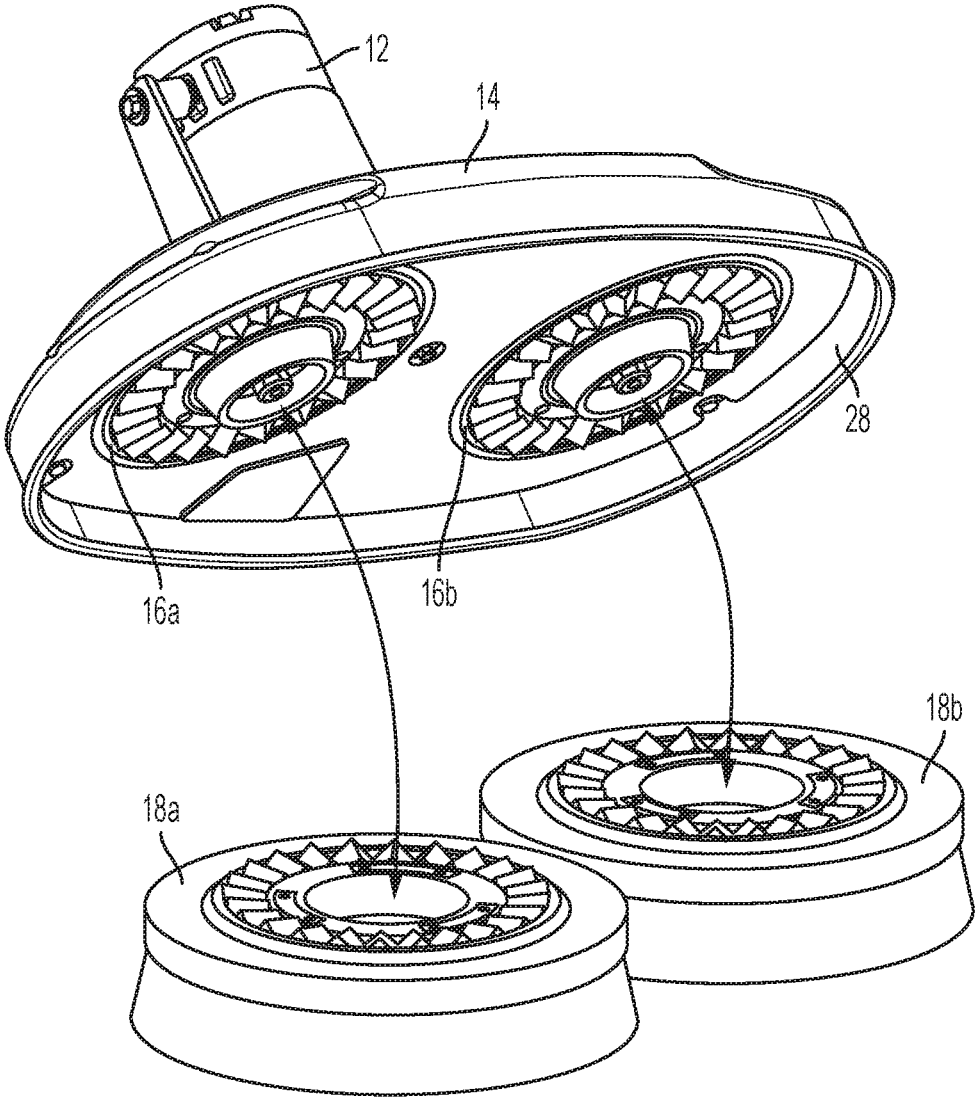
FIG. 23 is a perspective view of cleaning head assembly having dual hubs and dual pad drivers according to one embodiment.

Finally, in the embodiments of FIGS. 1-22*b*, the cleaning head assembly 10 includes a single hub 16 and a single pad driver 18. However, skilled artisans will understand that more than one hub 16 and pad driver 18 can be provided. For example, FIG. 23 illustrates an embodiment where two hubs 16*a*, 16*b* and two pad drivers 18*a*, 18*b* are provided.

Figure 25:
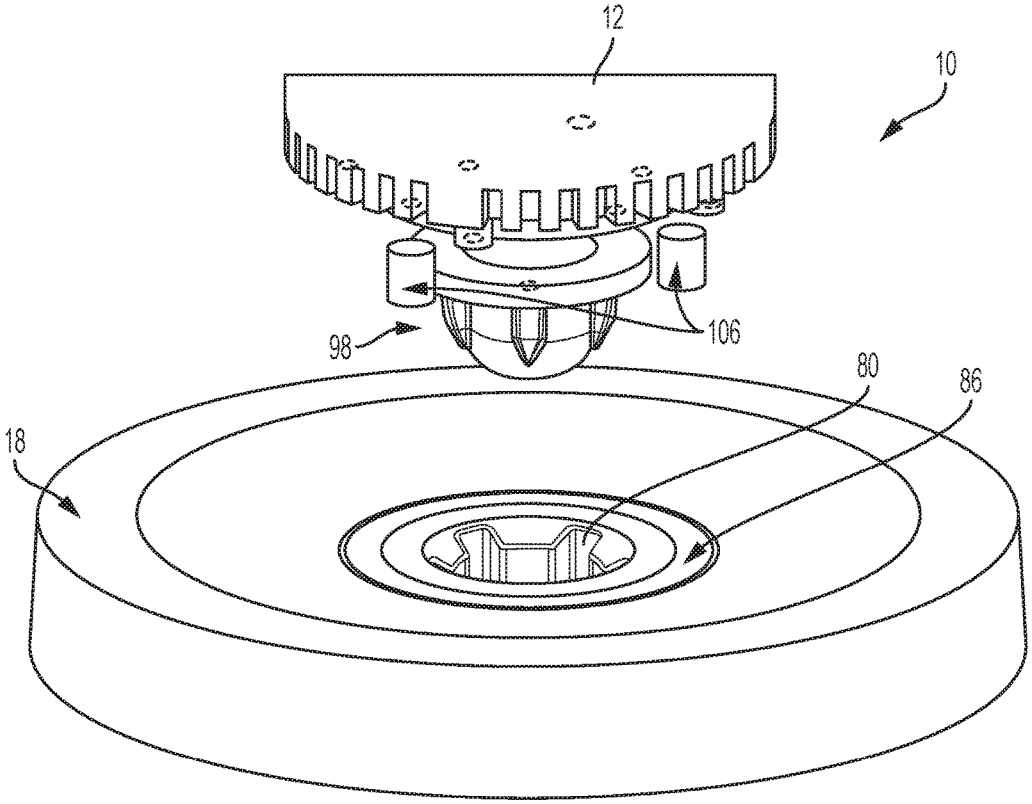
FIG. 25 is a perspective view of a cleaning head assembly according to another embodiment.
Figure 26:
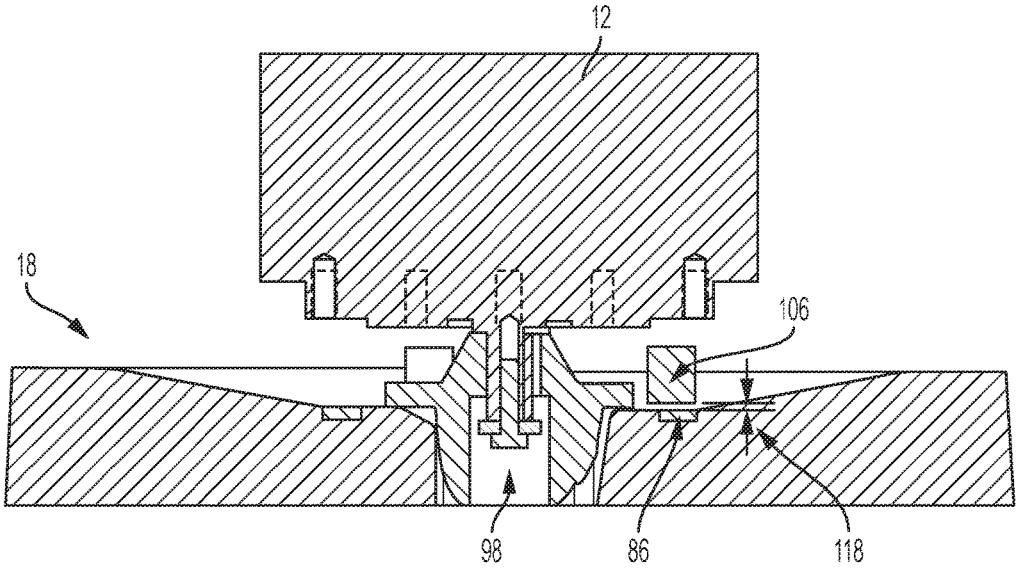
FIG. 26 is a cross section view of the cleaning head assembly of FIG. 25.
Figure 27:
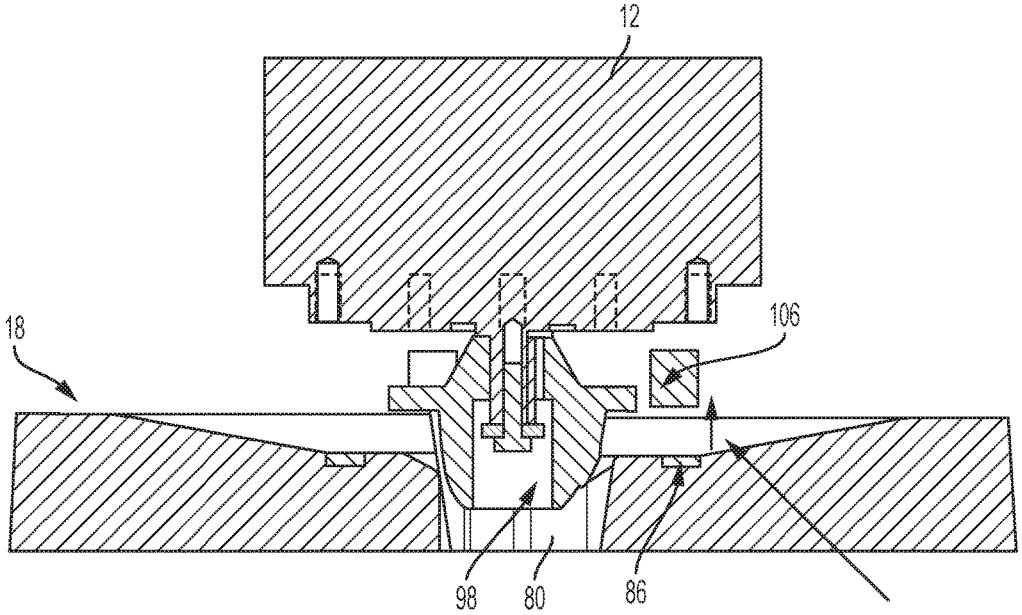
FIG. 27 is another cross section view of the cleaning head assembly of FIG. 25.

FIGS. 25-27 illustrate a cleaning head assembly 10 according to another embodiment. In this embodiment, the pad driver 18 includes a ring of magnet material 86. Also, the cleaning head assembly includes one or more ferromagnetic magnets 106 that attract to the magnetic material 86 on the pad driver 18. The ferromagnetic magnets 106 can be positioned anywhere in the cleaning head assembly such that it aligns with and attracts to the magnet ring 86. In some cases, the ferromagnetic magnets 106 are positioned within the cleaning head assembly at a location other than on a hub. In certain cases, the ferromagnetic magnets 106 are positioned in a deck or other housing of the cleaning head assembly 10. In yet other cases, the ferromagnetic magnets 106 are positioned such that they are at a location that is radially exterior to a hub of the cleaning head assembly 10.

The cleaning head assembly includes an aligning protrusion 98 (typically located on a hub) that inserts into an opening 80 on the pad driver. The aligning protrusion 98 in this embodiment includes a male keyed shape or configuration that inserts into and locks within a corresponding female opening 80 on the pad driver 18. Once the aligning protrusion 98 inserts into the opening 80, it locks within the opening 80 and can itself rotate to cause the pad driver 18. Also, as the aligning protrusion 98 inserts into the opening 80, the ferromagnetic magnets 106 attract to the magnet ring 86.

FIG. 26 shows the ferromagnetic magnets 106 in an attracted or attached position to the magnet ring 86. As shown, the ferromagnetic magnets 106 do not contact the magnet ring 86. Rather, the ferromagnetic magnets 106 and magnet ring have a gap in between them. This gap allows for the pad driver 18 to rotate while the magnets 86, 106 are attracted to each other.

FIG. 27 shows the ferromagnetic magnets 106 in an un-attracted or detached position to the magnet ring 86. When it is desired to detach the ferromagnetic magnets 106 from the magnet ring 86, an operator can simply activate the ferromagnetic magnets 106 to cause the ferromagnetic magnets 106 to repel the magnet ring 86. Once the ferromagnetic magnets 106 are detached from the magnet ring 86, an operator can simply deactivate the ferromagnetic magnets 86. Once deactivated, the ferromagnetic magnets 86 will again attract to the magnet ring 86 once properly aligned. Any system of activating and deactivating ferromagnetic magnets can be used. Such a system is advantageous because the activating is only performed during brief periods of detaching the magnets, which reduces battery needed to perform the activating.

In the foregoing detailed description, the invention has been described with reference to specific embodiments. However, it may be appreciated that various modifications and changes can be made without departing from the scope of the invention.

What is claimed is:

1. A cleaning head assembly for a floor surface maintenance machine comprising:

a rotatable pad adapted to be releasably loaded on or unloaded from the surface maintenance machine, the pad adapted to perform a surface maintenance operation on a floor surface, the pad having a pad driver and bristles, the pad driver adapted to couple the pad to a motive source and thereby impart a rotational movement to the pad, the bristles being coupled to an underside of the pad driver, the pad driver comprising a plurality of teeth, each tooth having a leading edge;

a central hub being releasably connectable to the pad driver, the central hub having a plurality of teeth, each tooth having a leading edge and being engageable with a respective tooth of the plurality of teeth of the pad driver in predetermined rotational positions, and one of the central hub and the pad driver having an axial aligning protrusion that has a frustoconical shape terminating at a leading edge, the other of the central hub and the pad driver having a central aperture with a leading edge, wherein, when the axial aligning protrusion is provided on the central hub, the leading edge of the axial aligning protrusion projects axially past the leading edge of each tooth of the central hub, and when the axial aligning protrusion is provided on the pad driver, the leading edge of the axial aligning protrusion projects axially past the leading edge of each tooth of the pad driver, such that the leading edge of the aligning protrusion extends toward the leading edge of the central aperture, the leading edges of each of the axial aligning protrusion, each tooth of the pad driver, each tooth of the hub, and the central aperture being defined as an edge of initial approach, as the central hub and the pad driver are axially moved toward each other, the central hub and the pad driver being engageable in an axial alignment position such that when the hub and the pad driver are engaged in the axial alignment position and into the one of the predetermined rotational positions, the motive source imparts the rotational motion to the pad; and a magnetic coupling provided between the hub and the pad driver, the magnetic coupling having a mutually attractive force associated therewith, the mutually attractive force of the magnetic coupling being configured to:

engage the pad driver and the hub together, facilitate relative rotational self-alignment between the hub and the pad driver into one of the predetermined rotational positions, and facilitate relative axial self-alignment between the pad driver and the hub to the axial alignment position.

2. The cleaning head assembly of claim 1, wherein the pad driver has a top surface and one or more magnets are positioned on the pad driver top surface and wherein the hub has a bottom surface and a ferromagnetic material is positioned on the hub bottom surface.

3. The cleaning head assembly of claim 1, wherein the hub has a bottom surface and one or more magnets are positioned on the hub bottom surface and wherein the pad driver has a top surface and a ferromagnetic material is positioned on the pad driver top surface.

4. The cleaning head assembly of claim 1 wherein the hub has a bottom surface, wherein the hub bottom surface includes the axial aligning protrusion, wherein the axial aligning protrusion has frustoconical shape terminating at a lowermost surface, wherein the lowermost surface of the frustoconical shape of the hub has a lowermost surface diameter, wherein the pad driver has the central aperture having a pad driver opening diameter, wherein the lowermost surface diameter is smaller than the pad driver opening diameter, the axial aligning protrusion facilitating axial self-alignment of the pad driver with the hub such that, when aligned and engaged, the motive source is operatively connected to the pad and imparts rotational motion to the pad.

5. The cleaning head assembly of claim 1 wherein the pad driver has a top surface, wherein the top surface includes the axial aligning protrusion, wherein the axial aligning protrusion has the frustoconical shape terminating at a topmost surface, wherein the topmost surface has a topmost surface diameter, wherein the hub has the central aperture having a hub opening diameter, wherein the topmost surface diameter is smaller than the hub opening diameter, the axial aligning protrusion facilitating axial self-alignment of the pad driver with the hub such that, when aligned and engaged, the motive source is operatively connected to the pad and imparts rotational motion to the pad.

6. The cleaning head assembly of claim 1 wherein the motive source is a motor having a drive shaft.

7. The cleaning head assembly of claim 1, wherein the pad driver comprises one or more magnets and the cleaning head assembly includes a component that comprises a ferromagnetic material, wherein the one or more magnets attract to the ferromagnetic material when the ferromagnetic material is deactivated.

8. The cleaning head assembly of claim 7, wherein the one or more magnets repel from the ferromagnetic material when the ferromagnetic material is activated.

9. The cleaning head assembly of claim 7, wherein when the one or more magnets attract to the ferromagnetic material, the pad driver couples to the hub.

10. The cleaning head assembly of claim 7, wherein after the one or more magnets attract to the ferromagnetic material, the one or more magnets are separated from the pad driver by a gap, the gap enabling the pad driver to rotate relative to the hub.

11. The cleaning head assembly of claim 7, wherein the pad driver contains one or more magnets and the cleaning head assembly includes a component that contains a ferromagnetic material, wherein the component that contains a ferromagnetic material is a deck.

12. The cleaning head assembly of claim 7, wherein the pad driver contains one or more magnets and the cleaning head assembly includes a hub and a ferromagnetic material, wherein the ferromagnetic material is not positioned on the hub.

13. The cleaning head assembly of claim 1, wherein the pad driver has one or more pad driver aligning teeth and the hub has one or more hub aligning teeth corresponding to the one or more pad driver aligning teeth, the one or more pad driver aligning teeth facilitating rotational alignment of the pad with the hub such that, when aligned and engaged, the motive source is operatively connected to the pad and imparts the rotational motion to the pad.

14. The cleaning head assembly of claim 1, wherein the axial alignment position corresponds to coaxial alignment of the central hub and the pad driver.

15. The cleaning head assembly of claim 1, wherein the central hub and the pad driver have a complementary shape such that one of the central hub and the pad driver is receivable by another of the central hub and the pad driver, the engagement of the complementary shapes of the central hub and the pad driver facilitating axial alignment between the pad driver and the hub to the axial alignment position.

16. The cleaning head assembly of claim 1, wherein the mutual attractive force of the hub and the pad driver results in relative movement of the hub and the pad driver toward each other, such that the hub and the pad driver are aligned axially and rotationally aligned during the relative movement of the hub and the pad driver toward each other.

17. A pad assembly for a surface maintenance machine, comprising:

a pad driver for connecting a pad to a motive source of the surface maintenance machine that transmits a rotational movement to the pad, the pad driver having:

a magnetic or ferromagnetic material to generate an attractive force to attach and facilitate rotational and axial self-alignment of the pad driver with the motive source, one or more pad aligning teeth facilitating rotational alignment of the pad with corresponding teeth on an interface of the motive source, the pad aligning teeth projecting axially from a topmost surface of the pad driver, the pad aligning teeth not being surrounded in a radial direction by any other portion of the pad driver, the pad aligning teeth each having a leading surface formed in sharp edges, each pad aligning tooth having a generally symmetric shape about an axis generally parallel to a rotational axis of the pad assembly, each pad aligning tooth being configured to mate with corresponding teeth on an interface of the motive source such that a mating engagement is established between the pad aligning teeth and the corresponding teeth of the interface of the motive source so as to provide a complementary rotational coupling therebetween, the leading surface of the pad driver teeth being configured to slip past a leading surface of the teeth of the interface of the motive source so as to provide touchless rotational self-alignment as the pad aligning teeth mate together with the corresponding teeth of the interface of the motive source, such that, when rotationally and axially aligned, the motive source is operatively connected to the pad and imparts the rotational motion to the pad, the pad driver configured for releasably loading to or unloading from the surface maintenance machine; and bristles fixed on the underside of the pad driver and adapted to be rotated with the pad driver to perform a surface maintenance operation on a floor surface when engaged to the floor surface.

18. The pad assembly of claim 17, wherein the pad is coupled to the pad driver by a holder assembly.

19. A cleaning head assembly for a floor surface maintenance machine comprising:

a rotatable pad adapted to be releasably loaded to or unloaded from the surface maintenance machine, the pad adapted to perform a surface maintenance operation on a floor surface, the pad having a pad driver and bristles, the pad driver adapted to couple the pad to a motive source and thereby impart a rotational movement to the pad, the bristles being coupled to an underside of the pad driver, the pad driver having one or more pad driver aligning teeth, the pad aligning teeth each having a leading surface formed in sharp edges; and a hub being releasably connectable to the pad driver, the hub having one or more hub aligning teeth of complementary shape to the one or more pad driver aligning teeth, the hub aligning teeth each having a leading surface, the leading surface of the pad driver teeth being configured to slip past the leading surface of the hub aligning teeth so as to provide touchless rotational self-alignment as the pad aligning teeth and the hub aligning teeth mate together, the one or more pad driver aligning teeth facilitating rotational alignment of the pad into one or more predetermined rotational positions with the hub, such that, when the hub and the pad driver are engaged together, the motive source imparts the rotational motion to the pad, the pad aligning teeth projecting axially from a topmost surface of the pad driver, the pad aligning teeth not being surrounded in a radial direction by any other portion of the pad driver, each pad aligning tooth having a generally symmetric shape about an axis generally parallel to a rotational axis of the pad assembly, each pad aligning tooth being configured to mate with corresponding teeth on an interface of the motive source such that a mating engagement is established between the pad aligning teeth and the corresponding teeth of the interface of the motive source so as to provide a complementary rotational coupling therebetween, a magnetic coupling provided between the hub and the pad driver, the magnetic coupling having a mutually attractive force associated therewith , the mutually attractive force of the hub and the pad driver being configured to:

engage the pad driver and the hub together, and facilitate touchless relative rotational self-alignment between the hub and the pad driver into one of the predetermined rotational positions.

20. The cleaning head assembly of claim 19, wherein the mutually attractive force of the hub and the pad driver facilitates axial alignment of the pad driver and the hub when the hub and the pad driver are engaged together.

21. The cleaning head assembly of claim 1, wherein the mutually attractive force of the magnetic coupling being configured to facilitate:

touchless relative rotational self-alignment between the hub and the pad driver, or touchless relative axial self-alignment between the pad driver and the hub.

22. The pad assembly of claim 17, wherein each pad aligning tooth having a ramped surface, the ramped surface of each pad aligning tooth slope downward from the leading surface of the pad aligning teeth to the topmost surface of pad driver.

23. The pad assembly of claim 22, the ramped surface of each pad aligning tooth contacting the topmost surface of pad driver.

24. The pad assembly of claim 22, the ramped surface of each pad aligning tooth contacting the ramped surface of an adjacent pad aligning tooth.

* * * * *